US005625967A

United States Patent [19]

Kulle

[11] Patent Number: 5,625,967

[45] Date of Patent: May 6, 1997

[54] DEVICE FOR CONTROLLING AT LEAST ONE ATTACHMENT

[76] Inventor: Jürgen Kulle, Stolberger Atrasse 125, 5500 Nordhausen, Germany

[21] Appl. No.: 910,267

[22] PCT Filed: Nov. 13, 1991

[86] PCT No.: PCT/EP91/02136

§ 371 Date: Jul. 15, 1992

§ 102(e) Date: Jul. 15, 1992

[87] PCT Pub. No.: WO92/08850

PCT Pub. Date: May 29, 1992

[30] Foreign Application Priority Data

Nov. 15, 1990 [DE] Germany ..... 40 36 466.6

[51] Int. Cl.[6] ..... E02F 3/32

[52] U.S. Cl. ..... 37/443; 414/694; 414/729

[56] References Cited

U.S. PATENT DOCUMENTS

| | | | |
|---|---|---|---|
| 3,214,040 | 10/1965 | Willinger | 414/695.7 |
| 3,463,336 | 8/1969 | Mork . | |
| 3,664,527 | 5/1972 | Short . | |
| 3,807,586 | 4/1974 | Holopainen . | |
| 3,871,538 | 3/1975 | Miller et al. . | |
| 3,915,501 | 10/1975 | Cobb et al. | 414/912 X |
| 4,049,139 | 9/1977 | Stedman | 414/694 |
| 4,077,140 | 3/1978 | Branconi | 37/443 |
| 4,100,688 | 7/1978 | Grist | 414/912 X |
| 4,257,731 | 3/1981 | Beaver | 414/694 |
| 4,268,217 | 5/1981 | Perreault et al. | 414/912 X |
| 4,274,796 | 6/1981 | Phillips | 414/694 X |
| 4,274,797 | 6/1981 | Coon | 414/694 |
| 4,285,628 | 8/1981 | Jankowski | 414/912 X |
| 4,353,424 | 10/1982 | Schenck et al. | 414/694 X |
| 4,403,429 | 9/1983 | Haringer | 37/443 |
| 4,669,947 | 6/1987 | Frost | 414/912 X |
| 4,950,127 | 8/1990 | Weyer | 414/694 |
| 5,158,420 | 10/1992 | Weyer | 414/694 |

FOREIGN PATENT DOCUMENTS

| | | |
|---|---|---|
| 0318271 | 5/1989 | European Pat. Off. . |
| 1340116 | 2/1963 | France . |
| 2333416 | 2/1976 | France . |
| 2153468 | 3/1973 | Germany . |
| 3142100 | 6/1982 | Germany . |
| 3843753 | 6/1990 | Germany . |

OTHER PUBLICATIONS

Patent Abstracts of Japan, vol. 7, No. 265 (M–258) (1410), 25 Nov. 1983.

Patent Abstracts of Japan, vol. 6, No. 232, (M–172) (1110), 18 Nov. 1982.

Patent Abstracts of Japan, vol. 6, No. 242 (M–175) (1120), 30 Nov. 1982.

Patent Abstrcts of Japan: M–202 Mar. 24, 1983, vol. 7/ No. 71.

Die Bauwirtschaft, vol. 3, Aug. 12, 1971, p. 1158.

*Primary Examiner*—John A. Ricci

*Attorney, Agent, or Firm*—Michael J. Striker

[57] ABSTRACT

A device for guiding at least one tool or auxiliary device has a base part, at least one boom articulated with the base part in an articulation and having at least two members connected with one another by a connection and also having an end supporting the tool. The connection of the members with one another and the articulation at the base part have hinge points formed for swivelling movements in at least one plane. At least two elements accommodate the at least two members and fastened to one another by pivot connections situated between the hinge points.

50 Claims, 20 Drawing Sheets

DEVICE FOR CONTROLLING AT LEAST ONE ATTACHMENT

BACKGROUND OF THE INVENTION

The present invention generally relates to a device for controlling at least one attachment.

This device can involve e.g. an excavator with a digging tool, e.g. a backhoe combination, attached to its boom.

Excavators with booms including a base boom articulated at the vehicle, an intermediate boom, and a handle carrying a digging tool are known from European Patent 0318 271 A1 and German Patent 38 43 753 A1. All parts of the boom are connected with one another via hinge points. In addition, either the base boom is rotatable relative to the vehicle around a horizontal axis or the intermediate boom is articulated so as to be rotatable relative to the base boom via a pivot connection whose axis extends substantially in the longitudinal direction of the base boom.

Excavators with booms whose respective excavator arm includes a base boom which can be constructed so as to be straight or angled and a handle carrying a digging tool are known from French Patent 2 333 416, U.S. Pat. No. 3,463, 336, U.S. Pat. No. 4,274,797 and Japan Patent 56-95637. The base boom and handle are connected with one another via an articulation or joint whose swiveling axis is oriented vertically relative to a plane defined by the handle and the base boom. Moreover, pivot connections are provided in the structure of the boom according to which the handle is rotatable relative to the base boom around an axis which is arranged so as to be fixed with respect to the base boom at which the handle is rotatable around an axis extending substantially in the direction of the longitudinal axis of the handle, or the base boom is rotatable relative to the vehicle around a vertically extending axis which is fixed with respect to the vehicle, or the base boom is constructed in two parts, with one part which carries the handle being rotatable relative to the other part around an axis extending in the direction of the longitudinal axis of the latter part of the base boom.

An excavator with a boom whose excavator arm includes a base Boom, an intermediate boom, and a handle carrying a digging tool is known from German Patent 31 42 100. The base boom is constructed in two parts and the part of the base boom facing the intermediate boom is articulated at both sides via pivot connections so that the intermediate boom and the handle are swivelable in a plane extending parallel to the longitudinal axis of the vehicle.

An articulation of the intermediate boom of an excavator boom at the base boom is known from DE-OS 21 53 468. In this case, the intermediate boom is swivelable relative to the base boom, around two axes which are vertical relative to one another.

Finally, an excavator boom with a telescoping handle is known from "CONSTRUCTION" [DIE BAUWIRTSCHAFT], issue 33, Aug. 12, 1971, page 1158.

A characteristic of all of these excavator booms consists in an articulated construction of the boom adapted to the respective specific purpose, possibly with the additional use of a pivot connection. These booms accomplish the tasks imposed on them. However, problems arise when conversion is required corresponding to a different type of digging tool and an increased movability of the end point of the boom carrying the tool relative to the vehicle is necessary.

SUMMARY OF THE INVENTION

Accordingly, it is an object of the present invention to provide a device of the above mentioned type, which is designed in such a way that the flexibility of the boom in carrying out movements is increased and this boom is suitable in particular for the guidance of different tools and other devices. In keeping with these objects and with others which will become apparent hereinafter, one feature of the present invention resides, briefly stated, in a device for guiding at least one tool or an auxiliary device in which, having a base part at which at least one boom having at least two members is articulated, the tool being located at one end of the latter, wherein the connection of the members with one another and the articulation and the base part has hinge points which are designed for realizing swivelling movements in at least one plane, wherein in accordance with the inventive feature at least two of the members are accommodated in at least two elements which are fastened to one another via pivot connections situated between the hinge points.

Accordingly, it is substantial to the invention that, in addition to the swivelable articulation of the individual members of the boom relative to one another on the one hand and at the base part on the other hand, at least two of the members are divided into elements which are fastened to one another via pivot connections. In connection with the known swiveling movements of the members relative to the base part and to one another, this enables a substantial increase in the degree of movability of the end point of the boom carrying the tool. The base part can be e.g. the vehicle of an excavator, crane or the like. But this can also involve an industrial robot or a comparable device used in stationary or mobile application for operating tools of different types, The type of tool used is optional in principle—its connection with the boom should have the simplest possible construction so that an uncomplicated exchange is possible if needed.

The pivot connection can be arranged at optional locations on the boom in principle, particularly also in the region of its articulation at the vehicle, and can be structurally combined at the latter with its swivelable articulation. Moreover, the angle of inclination of the axis of the pivot connection can also be constructed so as to be adjustable relative to a reference plane, e.g. the base plane of the vehicle.

The pivot connections should be constructed in principle in such a way that at least one rotation of 360° is possible. In many cases, however, smaller angles of rotation and swivel are also sufficient. For example, it is possible to improve the swivelable articulations of the members of the boom which are present anyway in such a way that swivel articulations around a plurality of axes extending parallel to adjacent cross-sectional planes of the boom part are structurally combined.

In accordance with a further feature, an independently controllable drive is associated with every pivot connection and every additional swivel articulation. This drive is preferably designed as a hydraulic drive. But it can also be an electric drive. A linear drive, e.g. a piston/cylinder unit, can be considered for use as a drive, but a rotary drive may also be taken into consideration.

The further features are directed to an embodiment form in which the movability of the boom relative to the base part is realized by a special articulation of the boom in connection with two piston/cylinder units which can be acted upon differently but in a controllable manner. The two piston/cylinder units have a common articulation point at the boom but separate articulation points at the base part so that swiveling movements of the boom are possible in two planes which are vertical with respect to one another by controlling the piston/cylinder units. All hinge points or articulations including those of the boom at the base part and of a pivot connection arranged at the latter are constructed as ball-and-socket or universal joints.

Still further features are directed to another construction of the end of the boom carrying the tool. For example, one or more supplemental arms can be articulated at this part of the boom, which supplemental arms are articulated in turn and outfitted with different drives which can be controlled by a motor for swiveling and rotating the individual members of the respective supplemental arm. Such embodiment forms are advantageous in industrial robots but also in other applications involving a cooperation or action of a number of different tools on one and the same object or workpiece.

Additional features are directed to different forms of structural combination of swiveling and rotating movements. Swiveling movements refer in this context to movements whose axes extend in adjacent cross-sectional planes of the boom, whereas rotating movements are always movements whose axes extend vertically relative to adjacent cross-sectional planes of the boom.

According to another feature the boom, particularly its elements, can be constructed so as to telescope. The same is true for the member elements of the Supplemental arm or supplemental arms. In particular, the combination of a plurality of pivot connections with the telescoping construction improves the adjusting or advancing movements between the tool and the location where it acts on an object.

An advantageous possibility for the control of and supply of energy to the tool consists in a corresponding hydraulic system. But other systems, including electrical systems, can also be considered. Accordingly, it is provided that a cable pull system be accommodated on the boom in addition so that a tractive force which-can be converted in an optional manner is available in the region of the end point of the boom. This cable pull system and possibly also an electrical system can be used alternately or in combination. Land vehicles may be road vehicles or rail-bound vehicles. Mobile or chain excavators, ship dredgers, ship cranes, tractor excavator loaders, fork lifts, wheel loaders, chain tractors, motor graders, wood moving machinery, contact harvesters, mobile cranes, loading bays, special vehicles, etc. can also be taken into consideration.

Various embodiment forms of the base part can be provided. Both mobile and stationary forms may be considered.

The base part can be outfitted with at least one balancing weight which is preferably arranged so as to be displaceable to compensate for the tilting moments. This measure which improves the stability of the device is particularly important in booms with telescoping ability. However, it also offers advantageous results and combinations with the pivot connections alone. The displaceable balancing weight is advisably connected with a system for detecting the momentary loading state which controls the position of the balancing weight. In an excavator the balancing weight is preferably arranged at the superstructure which is rotatably supported relative to the running gear.

It is evident that a great number of different tools can be used in principle and the fastening devices arranged at the end of the boom are constructed accordingly. Further, the base part also functions as a store and as accommodation for coolants, lubricants and other operating materials such as compressed air.

The pivot connections must enable a rapid swiveling of the parts of the boom relative to one another in every case, also when loaded, and must be capable of being fixed with the least possible play in predetermined rotational angle positions.

Angle measuring devices, particularly in combination with length measuring devices, which serve to recognize rotational angles and the position of telescoping connections of parts of the boom can be used for automatically detecting unfavorable loading conditions particularly in connection with an overriding control. This detection can be converted by means of control technology for use in a process of balancing weights, for introducing other measures to increase the protection against tilting, etc.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
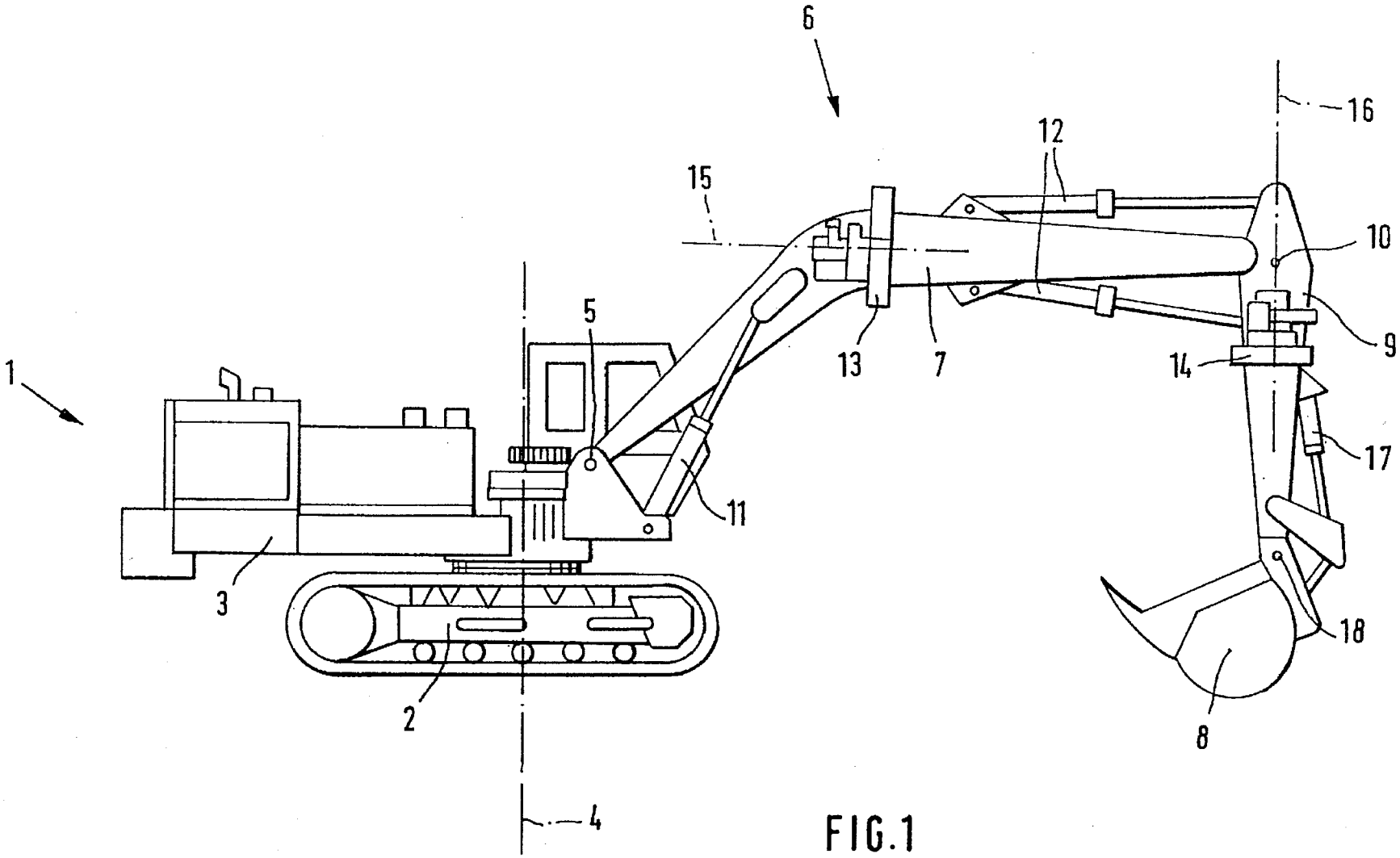
FIGS. 1 to 5 show embodiment examples of different embodiment forms of the excavator arm of a backhoe excavator.

In FIG. 1 the running gear of an excavator which, in a manner known per se, includes a chain running gear 2 on which an undercarriage 3 carrying all drive and control units is supported so as to be rotatable around a vertical axis 4 is designated in its entirety by 1. The nature of the vehicle which also includes a hydraulic system etc. will not be discussed in more detail in the following. In particular, the vehicle can also be of another optional kind, e.g. one outfitted with another running gear.

An excavator arm 6 is supported at the vehicle 1 so as to be swivelable around an axis 5 extending vertically relative to the drawing plane of FIG. 1. The excavator arm 6 has a base boom 7 which is articulated at the vehicle 1, a handle 9 carrying a digging tool 8, in this case a backhoe, being attached to the base boom 7. The handle 9 is swivelable relative to the base boom 7 around an axis 10 extending vertically relative to the drawing plane of FIG. 1.

Piston/cylinder units 11, 12 which are arranged in pairs and communicate with the hydraulic system of the vehicle in a manner not shown in the drawing are provided for the swiveling of the base boom 7 around the axis 5 and for the swiveling of the handle 9 around the axis 10.

The base boom 7 is constructed in an angled or bent manner and, like the handle 9, is divided into two parts which are connected with one another via a pivot connection 13, 14 to be described in more detail in the following. Each of these pivot connections enables a rotation of the parts communicating with one another via the latter by at least 360° and is provided with a special rotary drive as well as fixing devices for fixing discrete rotational angle positions of the parts.

The axis associated with the pivot connection 13 is designated by 15 and the axis associated with the pivot connection 14 is designated by 16. The rotary drives associated with the pivot connections 13, 14 are preferably constructed as hydraulic drives and communicate with the hydraulic system of the vehicle 1. It can be seen that there are many possibilities for positioning, and thus for the use of the digging tool 8 as a result of the rotating capability realized in this way for the two parts, i.e. the base boom 7 and handle 9.

The digging tool 8 is constructed in the usual way in the embodiment example shown in the drawing and is swivelable via a piston/cylinder unit 17 around an axis 18 extending vertically with respect to the drawing plane of FIG. 1.

Function elements conforming to those in FIG. 1 are also given the same reference numbers in FIGS. 2 to 5 so that a repetitive description of the latter can be dispensed with.

Figure 2:
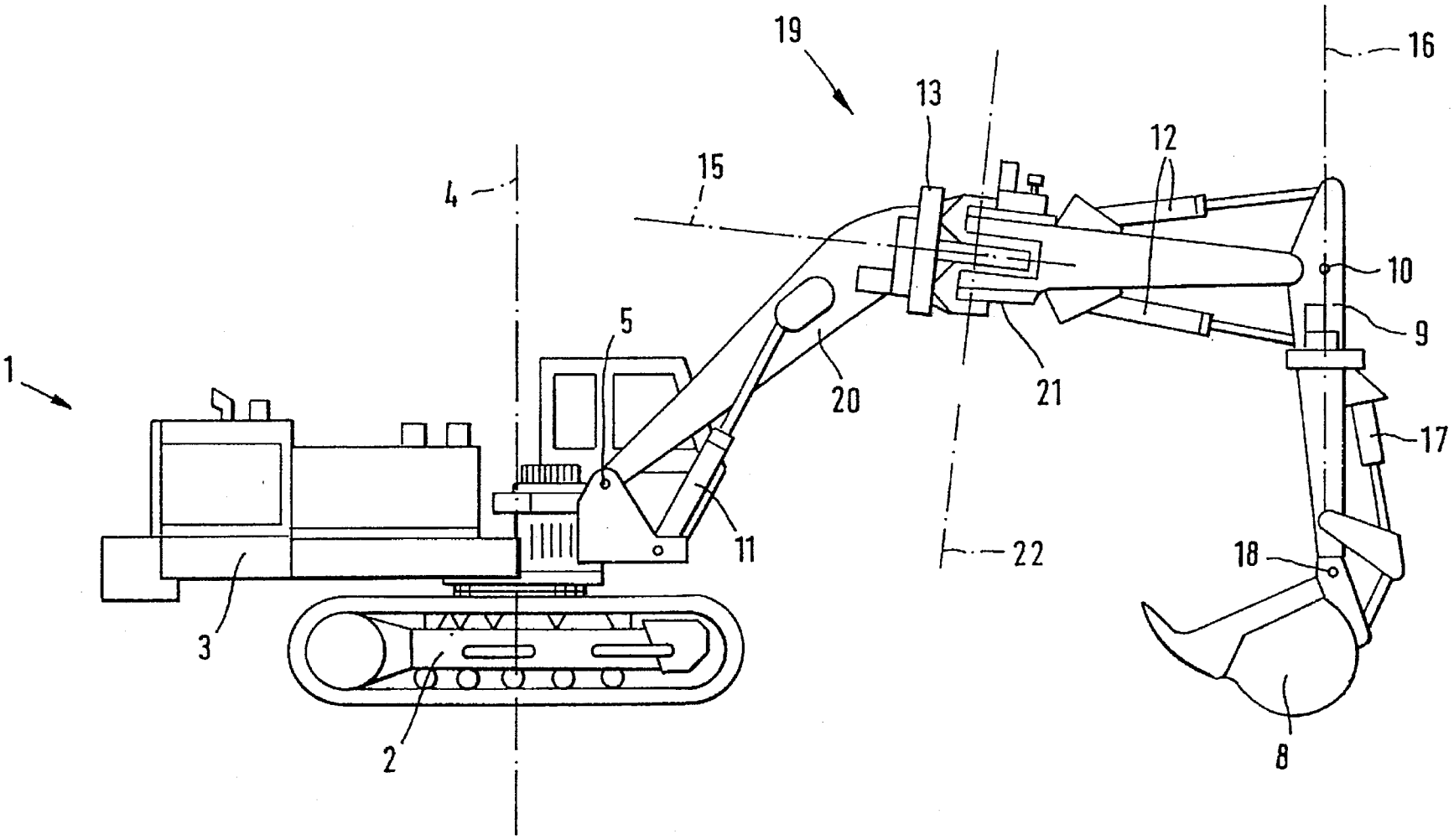

The excavator arm 19 shown in FIG. 2 differs from that according to FIG. 1 only in that the base boom 20, although again divided into two parts which are connected via a pivot connection 13 to which the axis 15 is associated, is provided with an additional pivot connection 21 which is directly adjacent to—and to a great extent structurally combined with—the pivot connection 13 and associated with the axis 22. This means that the end point of the base boom 20 remote of the axis 5 is additionally swivelable around the axis 22 corresponding to the two axes 15, 22 which are vertical to one another, which offers even more extensive adjusting or advancing possibilities for the digging tool 8. This double pivot connection characterized by the axes 15, 22 can be provided alternatively or simultaneously in the handle 9.

Figure 3:
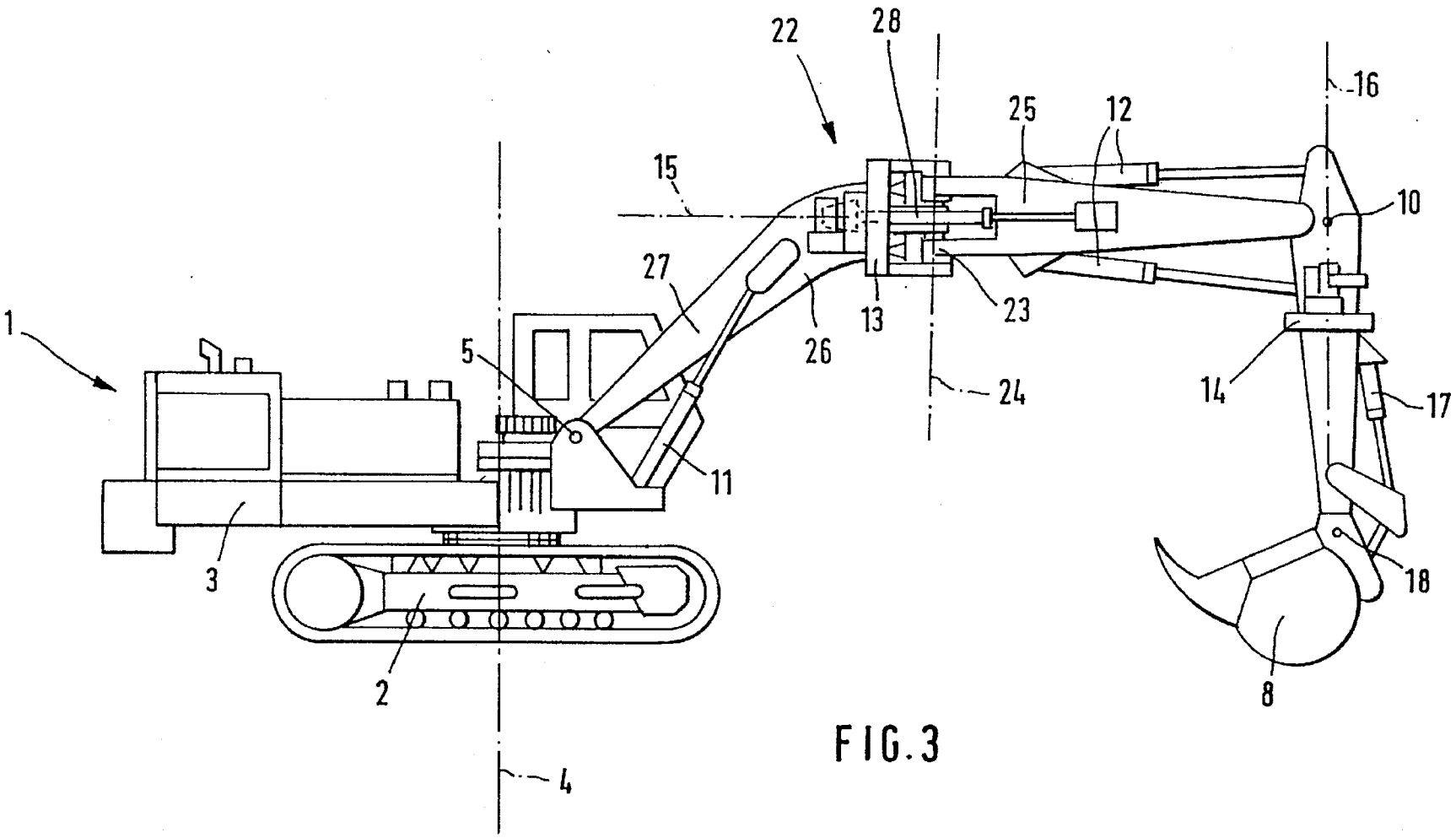

The excavator shown in FIG. 3 differs from that according to FIG. 2 only with respect to the construction of the excavator arm 2. The latter has another pivot connection 23 in addition to the pivot connection 13 with which axis 15 is associated. This additional pivot connection 23 is directly adjacent to the pivot connection 13, its axis 24 extending vertically with respect to the axis 15. The pivot connection 23 is characterized by a fork-shaped receptacle in which the part 25 of the base boom 26 is swivelable around the axis 24 relative to its part 27. Piston/cylinder units 28 arranged at both sides of the axis 24 serve for the swiveling. This double pivot connection characterized by axes 15, 24 can also be provided alternatively or simultaneously in the handle 9.

Figure 4:
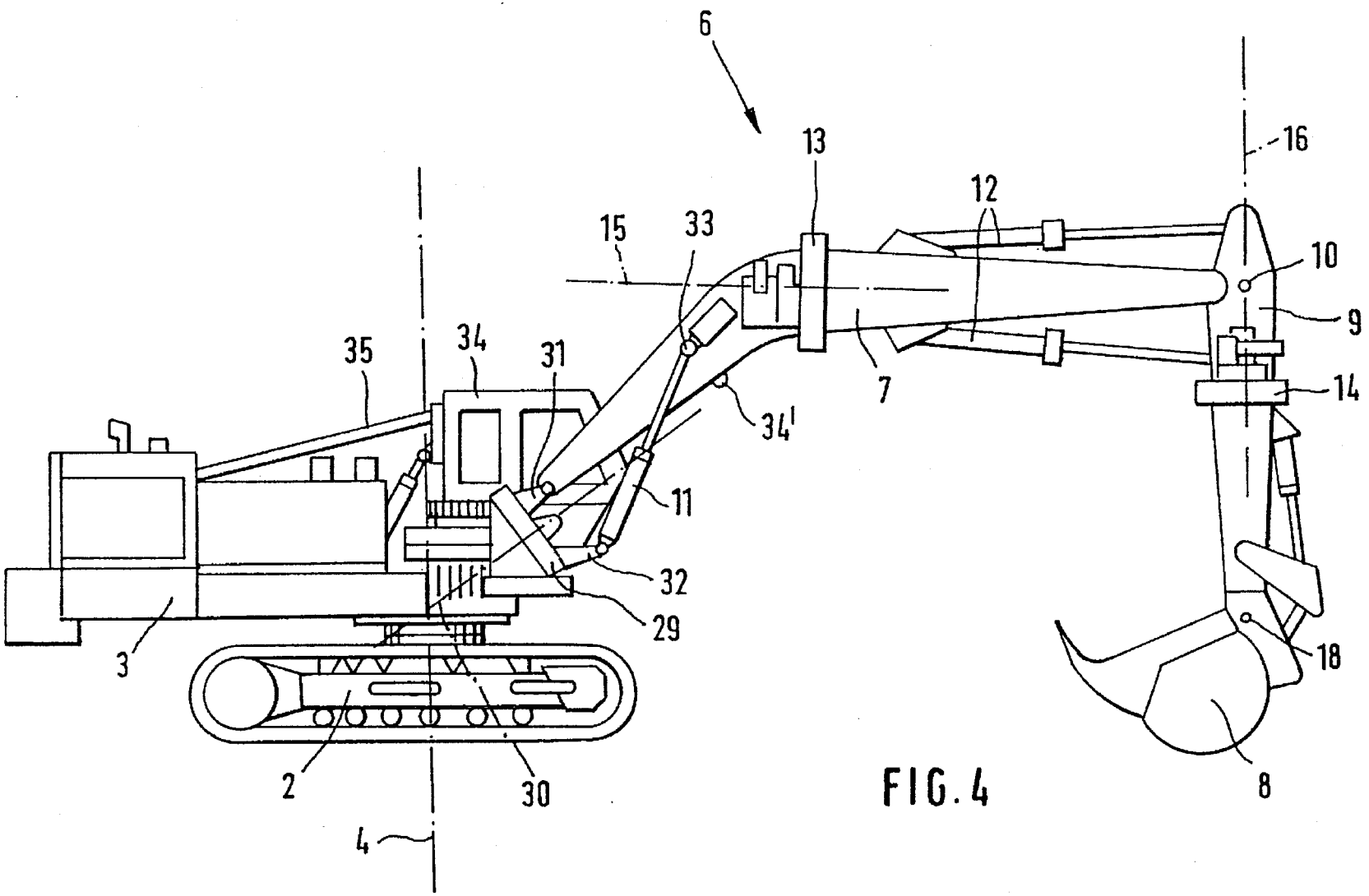

The excavator arm 6 of the excavator shown in FIG. 4 corresponds to that of FIG. 1 with the exception of its foot point articulation. This is characterized by a pivot connection 29 with associated axis 30. The pivot connection 29 forms a base for the articulation of the foot point of the excavator arm 6, which base is rotatable around the axis 30 by at least 360°. The latter articulation is characterized by a universal joint 31, and the piston/cylinder units 11 associated with the universal joint 31 and likewise articulated at the pivot connection 29 are articulated in turn at both sides via universal joints 32, 33. This means that the excavator arm 6 is swivelable relative to the pivot connection 29 in two planes which are vertical relative to one another and can accordingly be tilted laterally in particular, that is, in addition to the rotating capability provided by the pivot connection 29 relative to the axis 30. In this case, however, the driver's cab 34 should be offset at point 35 for safety reasons. A particularly advantageous configuration is provided when the piston/cylinder units are simultaneously articulated at the hinge point 34 of the boom. Swiveling possibilities of the boom in two planes which are vertical with respect to one another are provided when the piston/cylinder units can be acted upon independently of one another.

Figure 5:
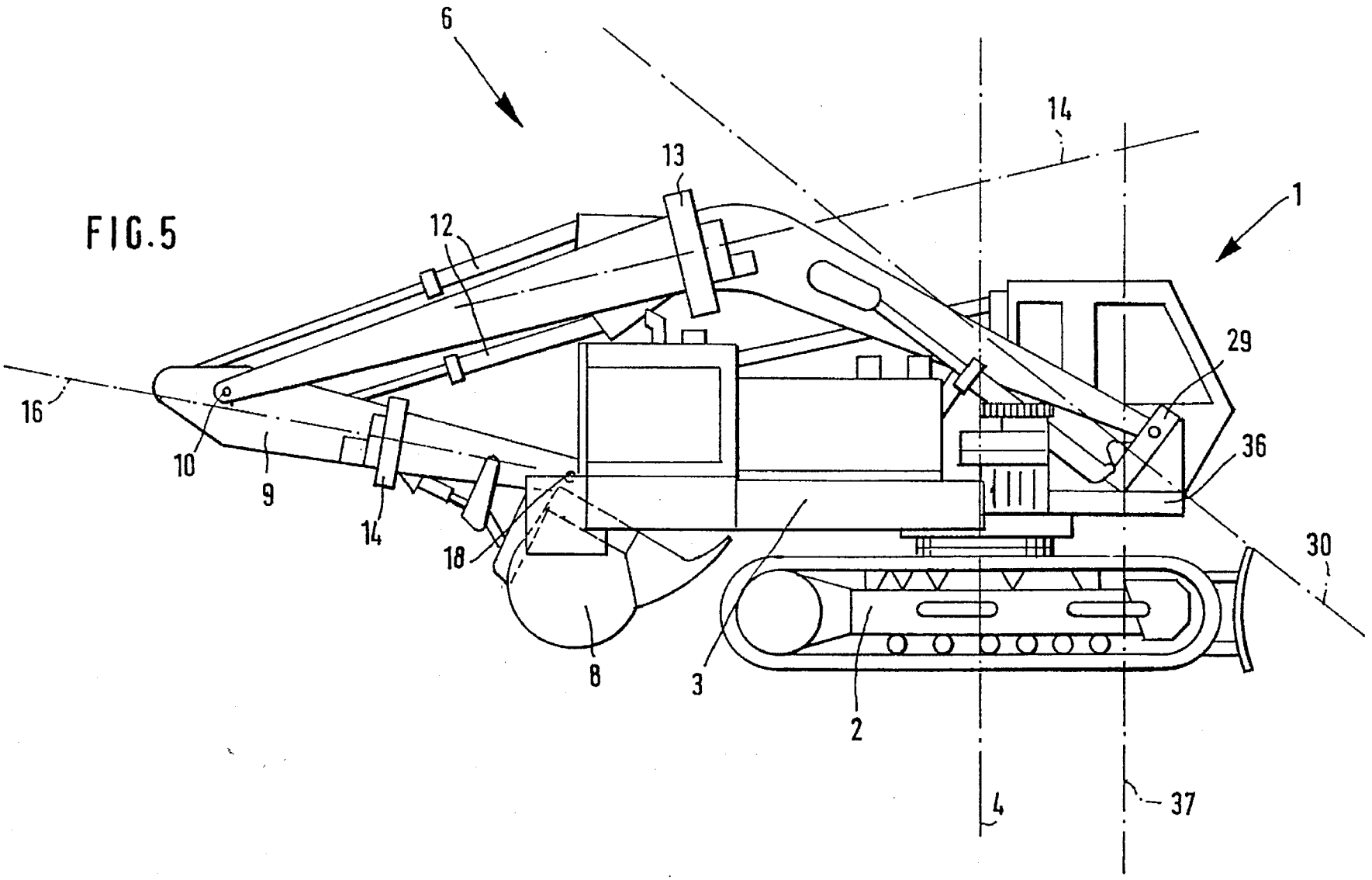

FIG. 5 shows an excavator with an excavator arm 6 whose foot point articulation differs from the embodiment form according to FIG. 4 in that another pivot connection 36 is provided whose axis 37 extends parallel to the axis 4 and accordingly extends vertically when standing on a level surface. The pivot connection 29 is connected with this pivot connection 36, while the articulation of the part of the base boom facing the pivot connection 29 is not shown in more detail in the embodiment example shown in the drawing. However, it can be constructed in principle in a manner similar to that in FIG. 4.

It is evident that multiple maneuvering possibilities for the digging tool 8 result from the possibility of controlling the individual members of the excavator arm along four axes in a stationary vehicle 1.

In the excavators shown in FIGS. 6 to 9 which differ from those shown in FIGS. 1 to 5, function elements corresponding to those in the latter are provided with the same reference numbers.

Figures 6, 7:
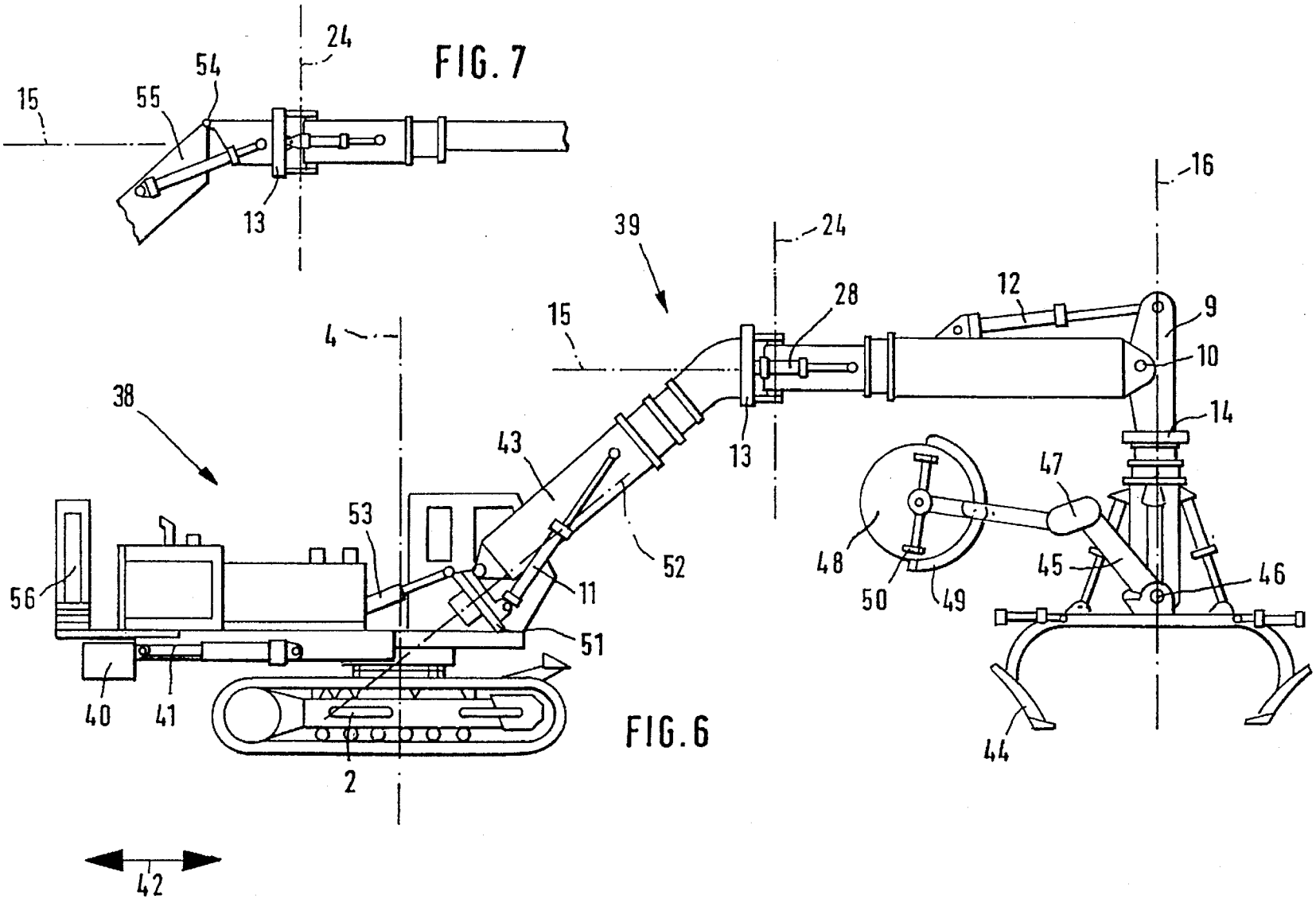
FIGS. 6 to 9 show various embodiment forms of excavator arms according to the invention with an additional tool.

FIG. 6 shows an excavator whose vehicle 38 is specially constructed to increase its stability against tilting moments caused by the excavator arm 39. To this end, the vehicle is provided with a balancing weight 40 which is movable along a straight line in the direction of arrow 42 by a piston/cylinder unit 41. The balancing weight 40 is located at the end of the vehicle 38 remote of the articulation of the excavator arm 39 and is displaced in the direction of arrow 42 corresponding to the loading of the excavator arm 39 to compensate for the tilting moments. A plurality of such balancing weights 40 can also be provided in principle.

Again, the base boom 43 has a bent construction and is characterized by a rotary transmission 13 with an axis 15 in a central portion. In addition to this, the parts are constructed on both sides of the rotary transmission 13 so as to telescope. The telescoping portions which are inserted within one another preferably move outward hydraulically. Another possibility for swiveling around the axis 24 by means of piston/cylinder units 28 is arranged adjacent to the rotary transmission 13. This embodiment form corresponds to that of FIG. 3 to this extent.

In another construction the handle 9 likewise telescopes below the pivot connection 14 and is preferably constructed so as to telescope hydraulically, namely in the direction of the axis 16.

The tool shown in FIG. 6 attached to the handle 9 is a gripper unit 44 which can be actuated in a manner known per se and serves e.g. to grasp heavy objects such as tree trunks. Further, a supplemental arm 45 which is swivelable relative to the handle 9 around an axis 46 vertically with respect to the drawing plane of FIG. 6 is arranged at the lower part of the handle. The supplemental arm 45 includes two members which are swivelable relative to one another around another axis 47 vertically with respect to the drawing plane, the outer member carrying a saw blade 48. A protective device surrounding one half of the circumference of the saw blade is designated by 49, while a pair of running wheels having a spherical circumferential surface, supported on the surface of the saw blade 48 in the peripheral region and serving as vibration damping is designated by 50.

In a particularly advantageous manner, the foot point of the supplemental arm 45 which is characterized by the ability to swivel around the axis 46 can be received, e.g. in a carriage, so as to be displaceable relative to the handle in the direction of the axis 16. Moreover, the foot point can be characterized by an attachment to the handle enabling a telescoping vertically with respect to the drawing plane.

A pivot connection which forms the tie between the excavator arm 39 and the vehicle 38 and enables a rotation of the excavator arm around the axis 52 is characterized by 51. Moreover, the angular adjustment of the axis 52 can be varied via piston/cylinder units 53.

FIG. 7 shows a modification of the excavator arm 39 insofar as the bending point in the base boom 43 is now characterized by an articulation whose axis extends vertically relative to the drawing plane of FIG. 7 and is designated by 54. A piston/cylinder unit 55 is provided for swiveling around this axis 54. This results in a number of possibilities for varying the adjusting or advancing movements of the end of the boom in connection with a foot point articulation of the boom at the vehicle or base part via a pivot connection.

Figure 8:
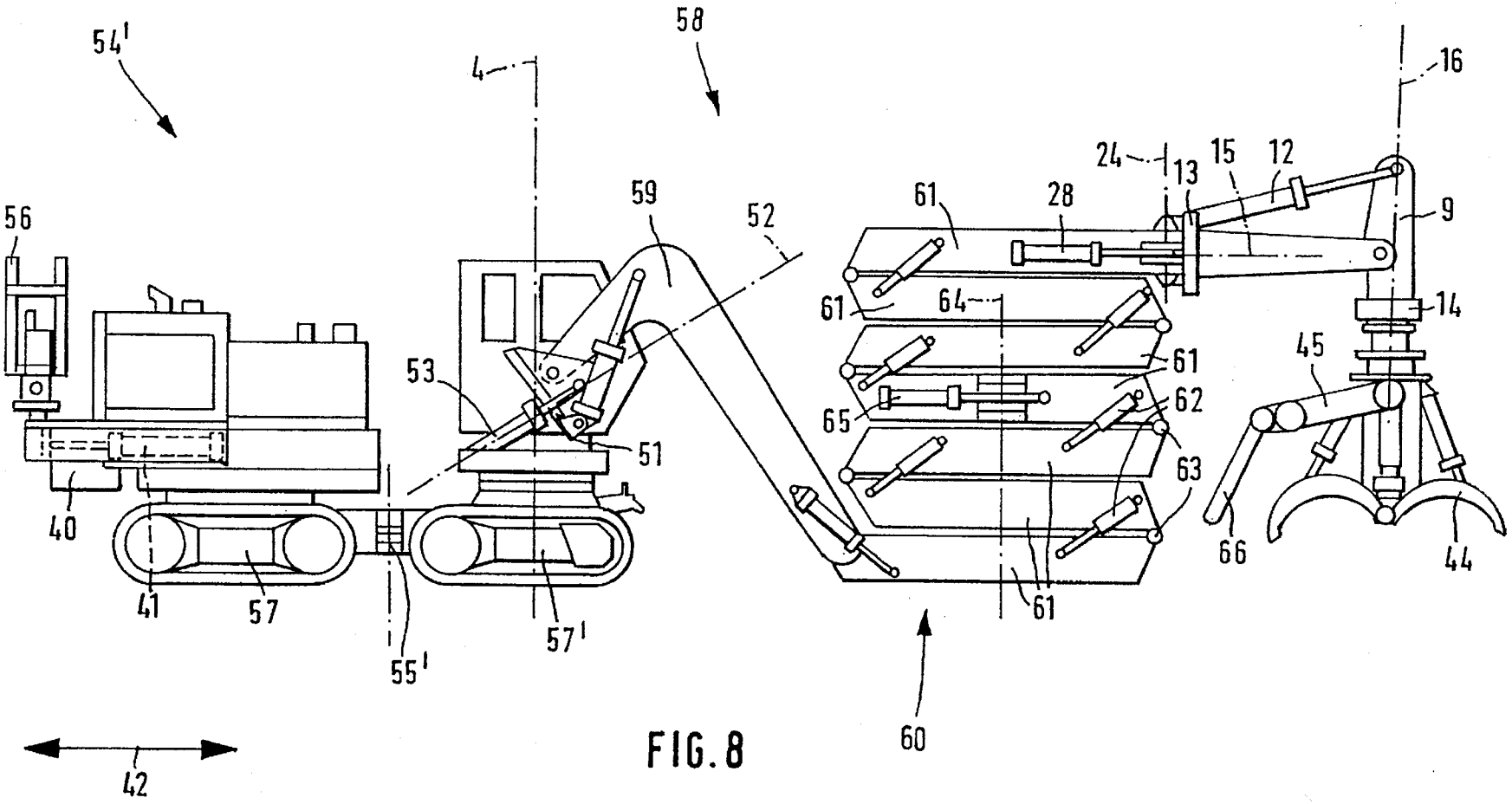

FIG. 8 shows a special form of a vehicle 54 insofar as it is composed of two parts which communicate via a hinge. The hinge which has a vertical swiveling axis is designated by 55.

Additional gripper members which are constructed and intended for handling heavy objects are designated by 56 in FIGS. 6 and 8.

Moreover, each of the two parts of the vehicle 54 is outfitted with tracklaying gear 57, 57'. However, the principle to be described in the following can be applied to optional center-pivot or other mobile excavators.

The excavator arm 58 has a foot point articulation conforming to that of FIG. 6 so that a repeated description is unnecessary.

The excavator arm 58 is characterized by a base boom 59, an intermediate part 60 and a handle 9. The intermediate part 60 includes a series of members 61 which are connected with one another via hinge points and constructed in a substantially identical manner. A piston/cylinder unit 62 is again associated with each hinge point and the axes of all hinge points 63 extend vertically with respect to the drawing plane of FIG. 8.

In the embodiment example shown in the drawing the members 61 can be divided into two groups which communicate with one another via a pivot connection characterized by the axis 64. This pivot connection is again associated with a piston/cylinder unit 65.

The handle 9 which is constructed so as to telescope in the direction of axis 16 is characterized by a gripper unit 44 and a supplemental arm 45 which corresponds to the supplemental arm 45 according to FIG. 6 with respect to its kinematic attachment to the handle and carries a chain saw 66.

Figure 9:
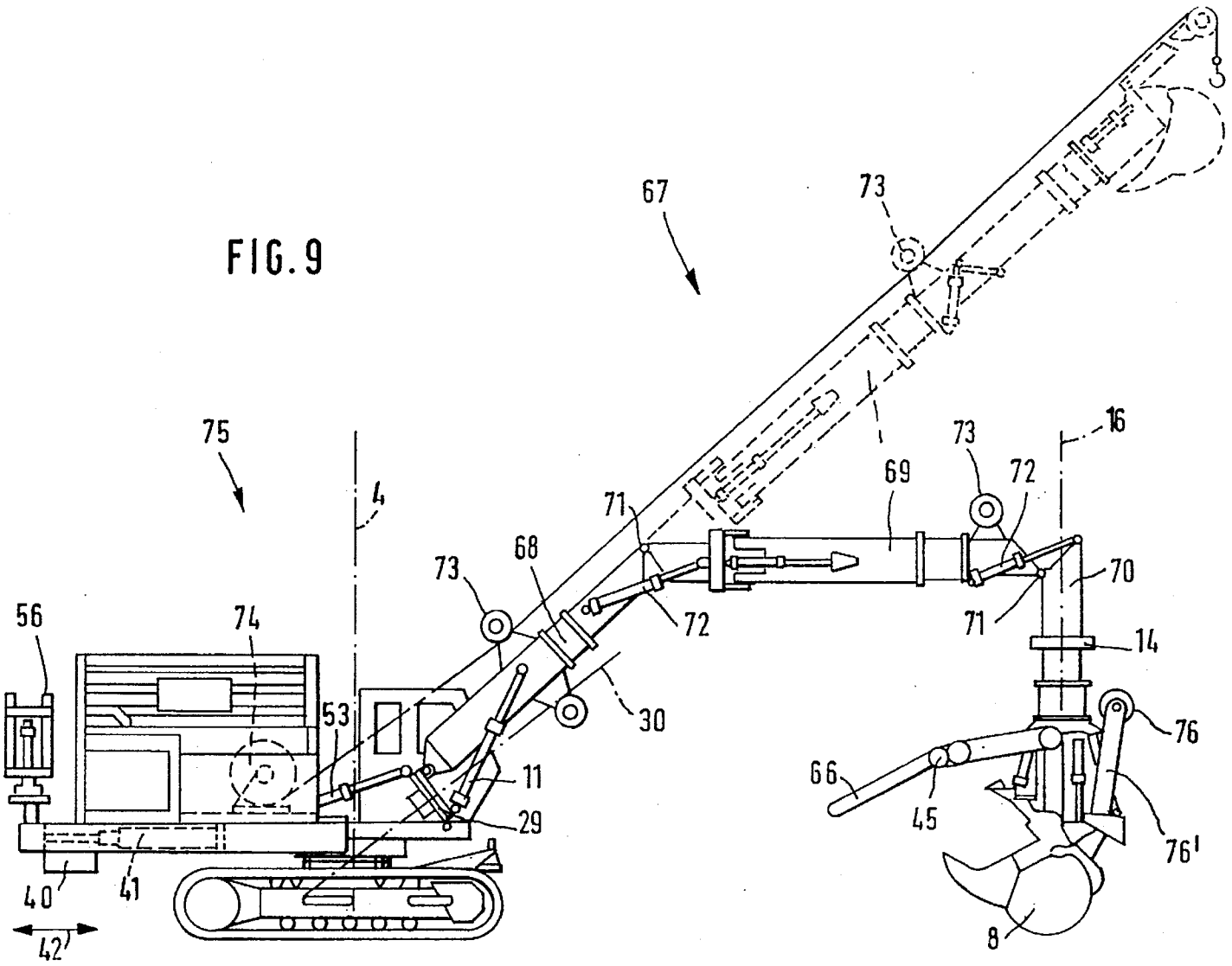

A substantial feature of the excavator shown in FIG. 9 is an excavator arm 67 having a base boom 68, an intermediate part 69 and a handle 70. At least one of these three members, namely the base boom, intermediate part or handle, is constructed so as to telescope. All three parts are connected via hinge points 71 and a piston/cylinder unit 72 is associated with each hinge point.

Running rollers intended for cooperation with a motor-driven cable winch 74 accommodated on the vehicle 75 are designated by 73. The cable winch 74 serves to provide an additional tractive force in connection with a cable winch wheel 76 which is arranged at the handle 70. The tractive force made available by the cable winch 74 can be converted into mechanical work in an optional manner, although this is not discussed in more detail.

Figure 10:
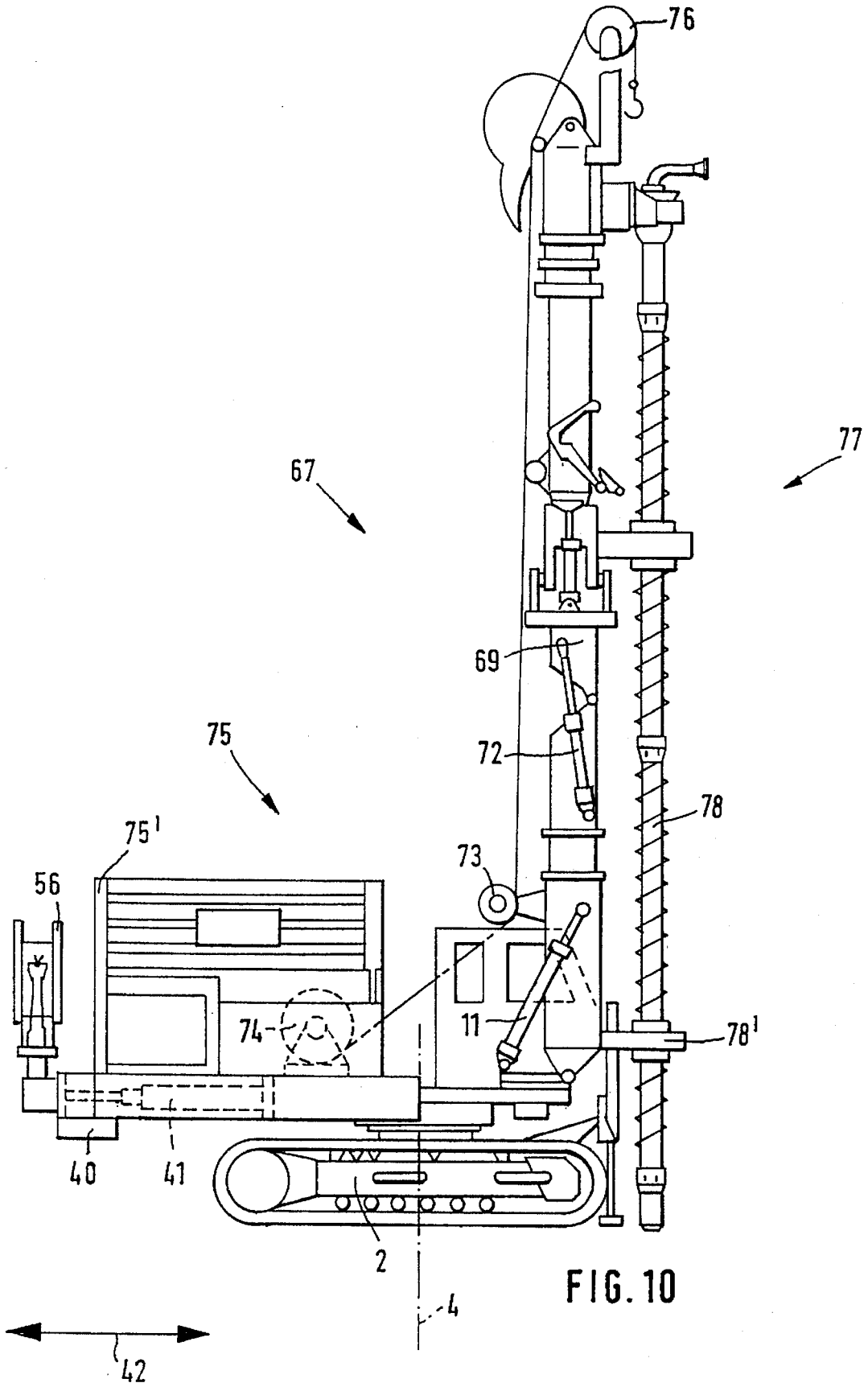
FIG. 10 shows an embodiment form of an excavator arm suitable for the attachment of a drilling device.

An excavator outfitted according to FIG. 9 can be used in a particularly advantageous manner as a carrier of a drilling device 77 (FIG. 10). To guide the drill rod 78, the boom can be outfitted with a plurality of bearings or drill guides as well as a rotary drive for the drill rods 78. A store 79 for drill rods or other tools can be accommodated on the rear part of the vehicle 75 simultaneously.

The lower drill guide designated by 78' can also be attached to the intermediate part 69 to increase variability.

Figure 11:
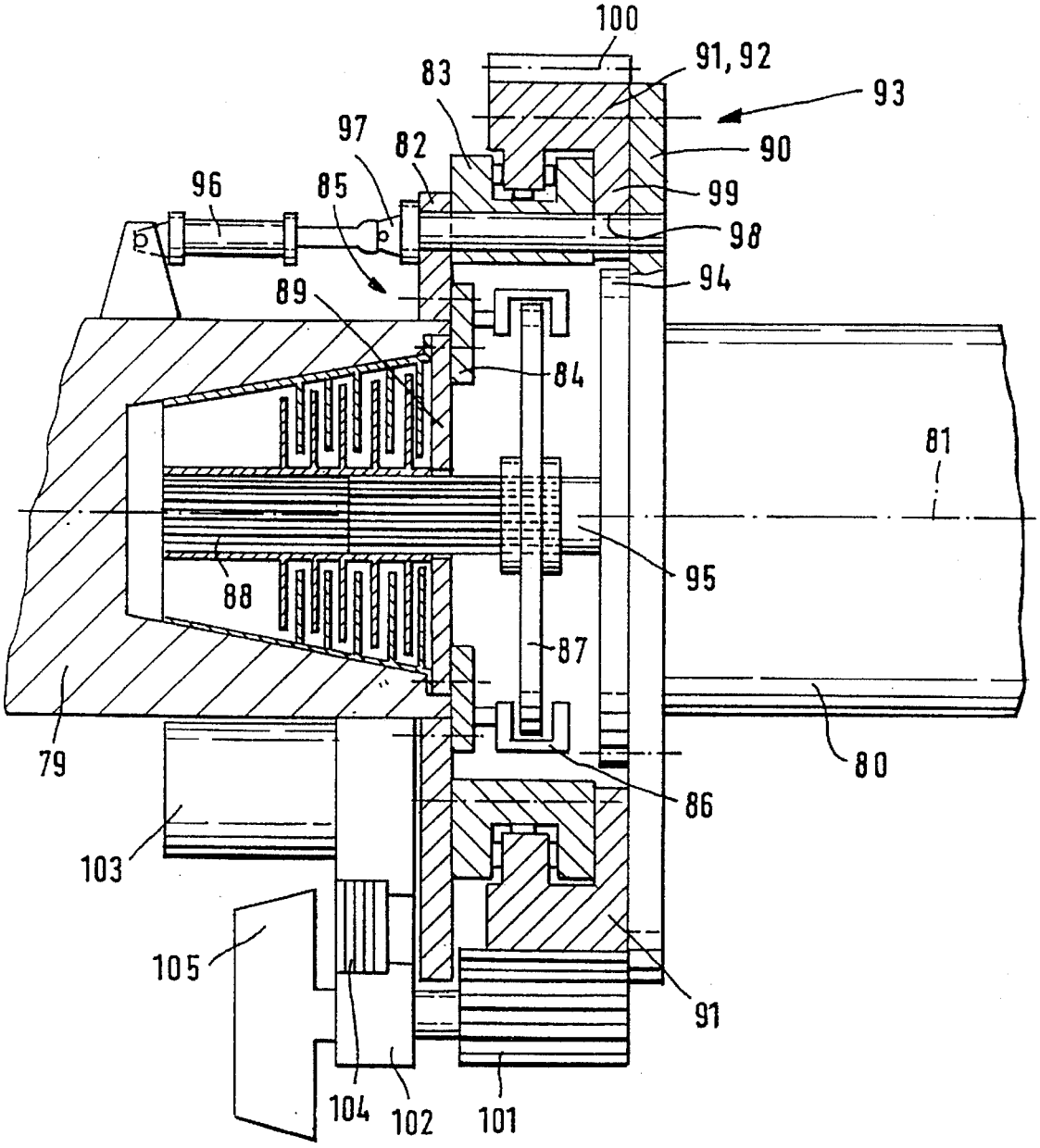
FIG. 11 is a sectional view of a first embodiment example of a rotary transmission intended for use in an excavator arm according to the invention.

FIG. 11 shows a first embodiment example of a pivot connection which with reference to the connection of a first part 79, e.g. of the end of the base boom of an excavator arm facing the vehicle 1, 38, 54 or 75, and a part 80 which adjoins the part 79 and is rotatable relative to the first part 79 around an axis 81 by means of a motor and can be stopped in optional angular positions.

The two parts 79, 80 are constructed as hollow constructions and can possibly be provided with struts. The hollow constructions can be polygonal, but also circular, etc. in cross section.

A fastening plate arranged at the front end of the part 79 is designated by 82. The fastening plate 82 is located on the outside of the part 79 at its front end and is securely connected with this part in a manner not shown in the drawing.

The inner ring 83 of a roller bearing enclosing the axis 81 is fastened at the fastening plate 82.

Further, a circular ring plate 84 is arranged at the fastening plate 82 in such a way that it projects into the cross section of the part 79. The circular ring plate 84 is screwed together with the fastening plate 82 as indicated at 85.

The circular ring plate 84 serves among other things as a support 86 of brake devices which cooperate with a brake disk 87 in a manner to be described further.

The circular ring plate 84 further serves on its side remote of the support 86 for the attachment of a device containing a multiple-disk brake 88 via a circle plate 89 which is screwed together with the circular ring plate 84. The multiple-disk brake 88 extends inside the part 79.

A fastening plate, designated by 90, is securely connected with the front end facing the part 79 and carries an outer ring 91 on its outside, which outer ring 91 forms a roller bearing 92 with the inner ring 83. The outer ring 91 is screwed together with the fastening plate 90 as indicated at 93. The roller bearing 92 formed in this manner can be constructed as a universal roller bearing or a comparable bearing.

A circular plate 94 is located on the fastening plate 90, i.e. on its side facing the part 79, and is screwed together with the fastening plate 90. The circular plate 94 which extends vertically relative to the axis 81 carries a shaft 95—i.e. coaxially relative to the axis 81—which is securely connected with the circular plate 94 and accordingly with the part 80. The brake disk 87 is supported on the shaft 95 via a spline-shaft toothing or the like and the continuation of this shaft 95 projects further into the aforementioned multiple-disk brake 88 in such a way that a group of disks communicate with the shaft 95 so as to be rigid against torsion.

The multiple-disk brake can be actuated in a conventional fashion in that the disk group rotating with the shaft 95 relative to its housing is displaced axially relative to a disk group which is rigidly connected with its housing so as to apply the necessary braking moment. The actuation and more precise construction of this multiple-disk brake 88 will not be treated at greater length.

A piston/cylinder unit arranged at the part 79, i.e. at its outside, is designated by 96. Its piston communicates with a stop pin 97 to be inserted into bore holes 98 which penetrate the fastening plate 82, the inner ring 83, a part 99 attached to the outer ring, and the fastening plate 90. Since the inner ring 83 is connected with the part 79 and the outer ring 91 is connected with the part 80 via the fastening plate 90, an inserted stop pin 97 completely penetrating the aforementioned bore hole 98 prevents a relative rotation of the parts 79, 80 around the axis 81. As a rule, a plurality of such locking devices outfitted with piston/cylinder units 96 are provided so as to be uniformly distributed around the circumference.

The outer ring 91 is provided with an outer toothing 100 which meshes with the pinion 101 of a gear unit 102 which is connected in turn with a motor 103, preferably a hydromotor. The gear unit 102 and the motor 103 form a structural unit which is arranged on the side of the fastening plate 82 remote of the inner ring 83, i.e. in this instance it is screwed together with the fastening plate 82. Another brake device 104 can also be structurally combined with the gear unit 102 in the manner of a multiple-disk brake. Finally, a parking brake which acts directly on the pinion 101 is designated by 105.

The system shown in FIG. 11 is outfitted with various brake devices, namely multiple-disk brakes 88, 104 and a disk brake which is formed by the support 86 in connection with the brake disk 87. Further, two different retaining devices are provided for locking the rotational angle of the part 80 relative to the part 79, namely a system of stop pins 97, which can be actuated via piston/cylinder units 96, and a parking brake 105. These brake devices can be provided alternatively as well as in combination so that optimal possibilities are provided not only for a very quick and effective braking, particularly under load, but also for a fastening of the parts 79, 80 relative to one another practically without play regardless of the inevitable tolerances in gear units. Further, it can be seen that after the conclusion of a rotating member by a motor 103 it is possible to lock the parts 79, 80 in the respective rotational angle positions without the cooperation of the motor 103.

Figure 12:
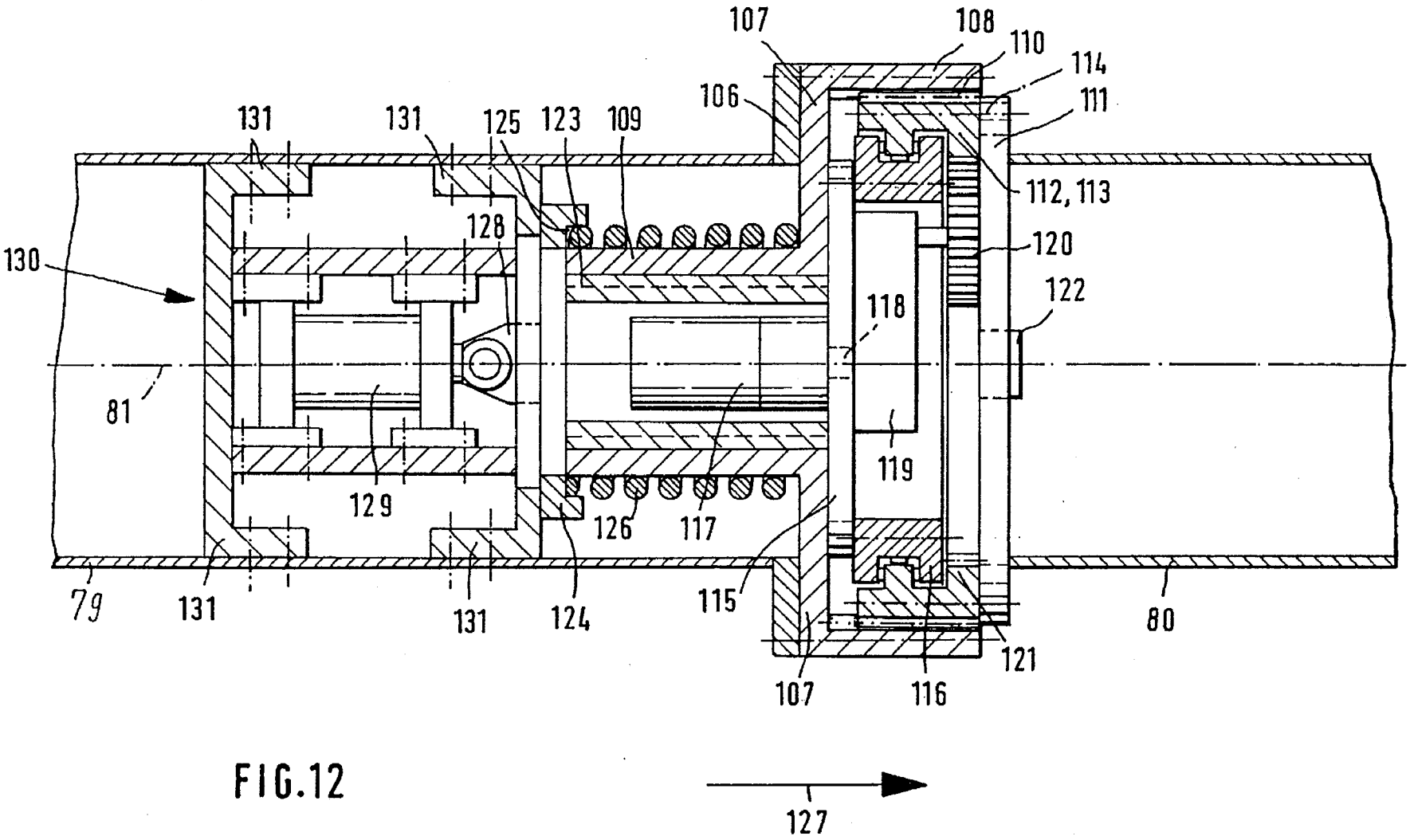
FIG. 12 is a sectional view of another embodiment example of a rotary transmission intended for use in an excavator arm according to the invention.

FIG. 12 shows another embodiment example of a pivot connection which is explained with reference to the connection of two parts 79, 80, the axis of the pivot being designated by 81. A fastening plate 106 is located at the front end of the part 79 so as to project away from the latter radially at the outside and has a fixed connection, not shown in the drawing, with the part 79. A circular ring plate 107 is arranged on the fastening plate and continues at its radially outer end into a cylindrical part 108 extending coaxially relative to the axis 81 and on its radial inner side into a cylindrical guide part 109 which likewise extends coaxially relative to the axis 81. The cylindrical part 108, the circular ring plate 107 and the guide part 109 can be constructed in one piece—but these parts can also be constructed as individual parts which are suitably fastened to one another. Instead of a cylindrical guide part 109, a guide part with a polygonal cross section etc. can also be provided.

The cylindrical part 108 is provided with teeth 110 on its radial inner side, the significance of which will be discussed in more detail in the following.

A circular ring plate which is securely connected with the front end of the part 80 and projects away from the latter radially at the outer side is designated by 111. The construction of the connection between the circular ring plate 111 and the part 80 can be optional in principle.

The circular ring plate 111 carries the outer ring 112 of a roller bearing 113 on its axial side facing the part 79. The operation of the roller bearing 113 will likewise be discussed in the following. The outer ring 112 is fastened to the circular ring plate 111 in a suitable fashion, a screw connection being indicated at 114 in the embodiment example shown in the drawing. The outer ring 112 carries teeth on its radial outer side which engage with the teeth 110 of the cylindrical part 108.

A circle plate which is arranged on the side of the circular ring plate 107 remote of the fastening plate 106 and is screwed together with the circular ring plate 107 is designated by 115. The circle plate 115 extends coaxially relative to the axis 81 and supports the inner ring 116 of the roller bearing 113 at its radially outer regions. The roller bearing 113 can be constructed as a universal roller bearing or as a roller bearing of some other type.

A motor 117, preferably a hydromotor, is supported on the side of the circle plate 115 facing the part 79. Its driven shaft 118 penetrates a bore hole of the circle plate 115, which bore hole is coaxial to the axis 81, and is connected with a pinion 120 via a gear unit 119 fastened at the circle plate 115, which pinion 120 is located in the radially outer region of the latter. The outer ring 112 has a lateral portion 121 which is provided with inner teeth engaging with the pinion 120.

The motor 117 serves to rotate the parts 79, 80 around the axis 81 relative to one another.

An angle measuring device which detects the angle of rotation of the parts 79, 80, the significance of which will be discussed in the following, is designated by 122.

The drive connection can also be effected via the inner ring of a roller bearing 91, 113 in contrast to the preceding embodiment examples for the purpose of the rotation of the parts 79, 80.

A cylindrical guide pipe which is fastened at one end to the circular ring plate 115 and carries a retaining ring 124 at its other end is designated by 123. The guide pipe 123 is guided inside the guide part 109 so as to be fixed with respect to rotation via a dovetail guide or comparable function element and the guide part 109 is provided with slot-like cut out portions which are penetrated by a peg-shaped center part of the holder 124 whose radially outer part is constructed in the manner of an annulus whose annular body has an angular cross-sectional shape and is guided on the outside of the guide part 109. The holder 124 forms an axially extending annular groove 125 which serves to receive a spring element 126 which encloses the guide part 109 and contacts the holder 124 at one end and the circular ring plate 107 at the other end. When the guide pipe 123 is displaced relative to the guide part 109 in the direction of arrow 127 the spring element 126 accordingly acts as a return spring.

A coupling device by which the center part of the holder 124 is connected with the piston of a piston/cylinder unit 129 is designated by 128. The piston/cylinder unit 129 is received in a frame 130 which is arranged so as to be stationary relative to the part 79 and is screwed together with the latter e.g. by retaining elements 131 which simultaneously exert a stiffening effect against torsional strain.

In the position of the two parts 79, 80 shown in FIG. 12, the latter are connected with one another via the teeth 110 so as to be rigid against rotation and possible play in the region of the teeth 110 is bridged by the motor 117 in connection with the gear unit 119, pinion 120 and inner teeth of the inner ring 112. The holder 124, the guide pipe 123, and the circle plate 115 including the roller bearing 113 are displaced in the direction of the arrow 127, i.e. opposite the restoring force of the spring element 126, for the rotation of the part 80 relative to the part 79 by the application of pressure on the piston/cylinder unit 129 via the coupling device 128. This displacement is effected by an amount such that the engagement of the teeth of the outer side of the outer ring 112 and the inner side of the cylindrical part 108 is disengaged so that the part 80 can be rotated around the axis 81 relative to the part 79 subsequently via the motor 117 and the pinion 120. When the final rotational position which is detected with the cooperation of the angle measuring device 122 is reached in this way, the piston/cylinder unit 129 is not acted upon by pressure so that the meshing between the outside of the outer ring 112 and the inside of the cylindrical part 108 is restored under the influence of the spring element 126. Moreover, a precision alignment of the toothing profiles of the aforementioned outer ring and cylindrical part which are to be brought into engagement with one another can be carried out with the aid of the angle measuring device 122, in particular an alignment of successive tooth flanks and tooth gaps, so as to prevent damage to the toothing profiles as a result of the engaging and disengaging processes.

Figure 13:
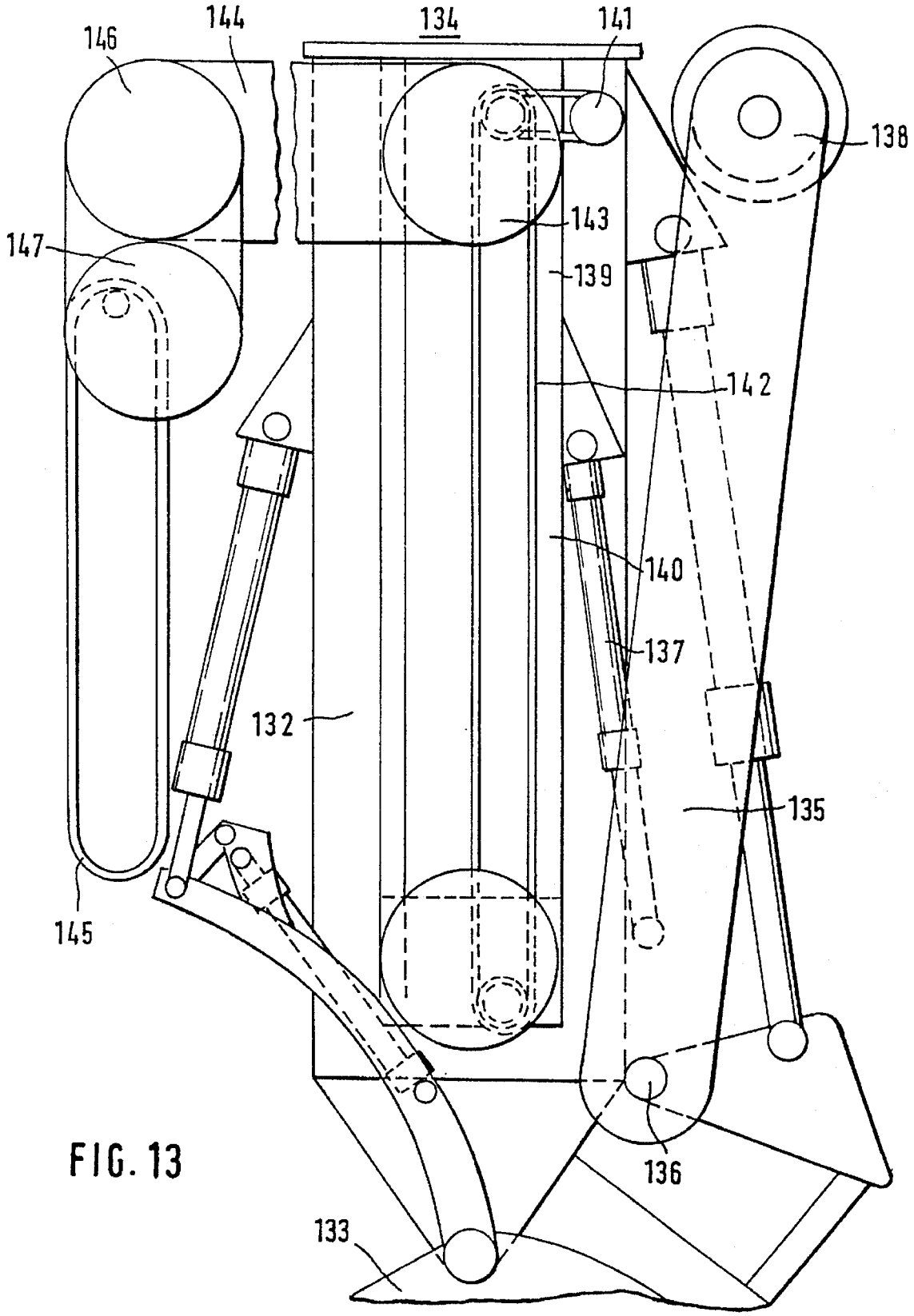
FIG. 13 shows a front view of the handle of an excavator arm according to the invention which is set up for the attachment of additional tools.
Figure 14:
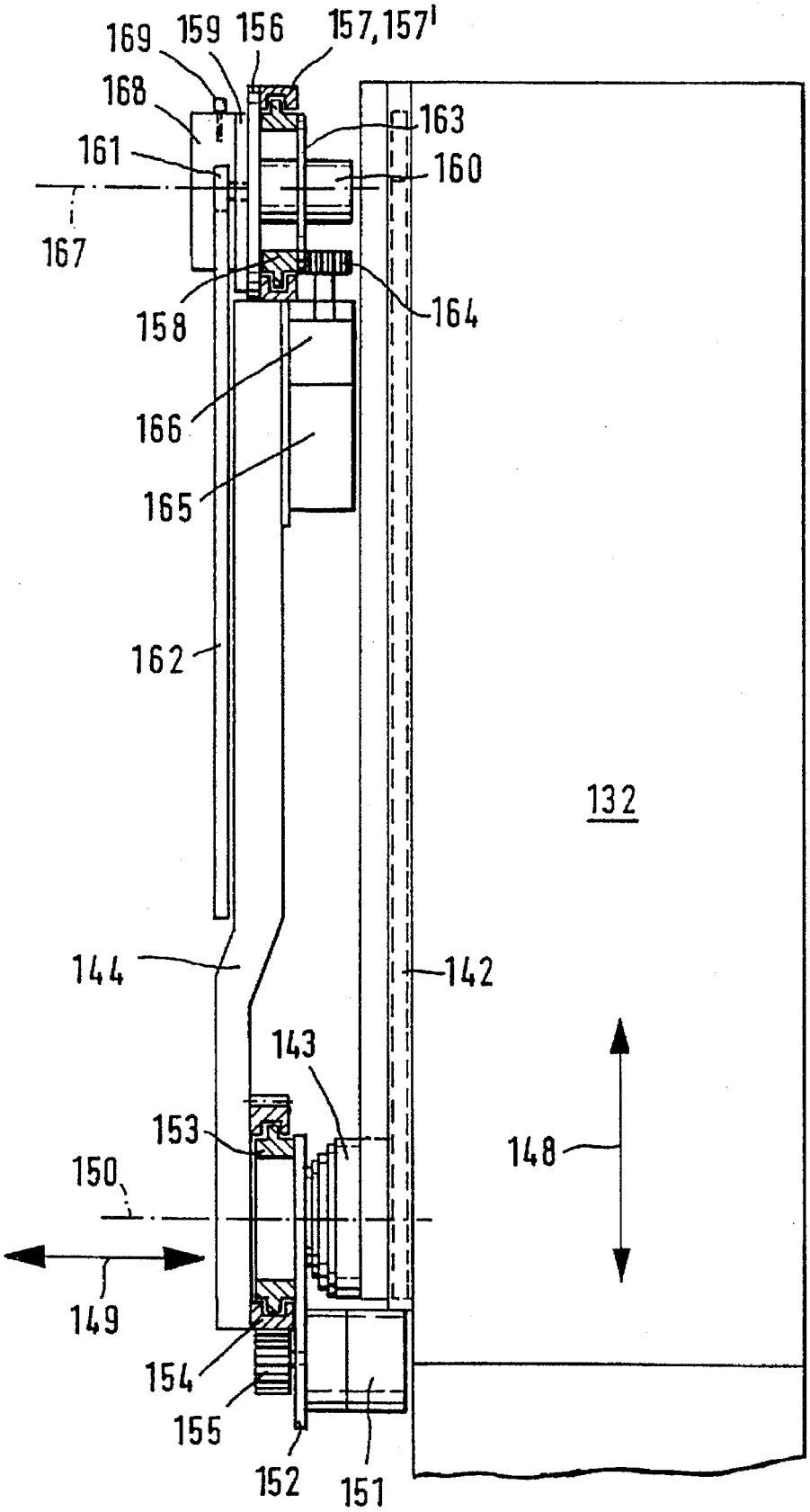
FIG. 14 is a side view of the handle according to FIG. 13.
Figure 15:
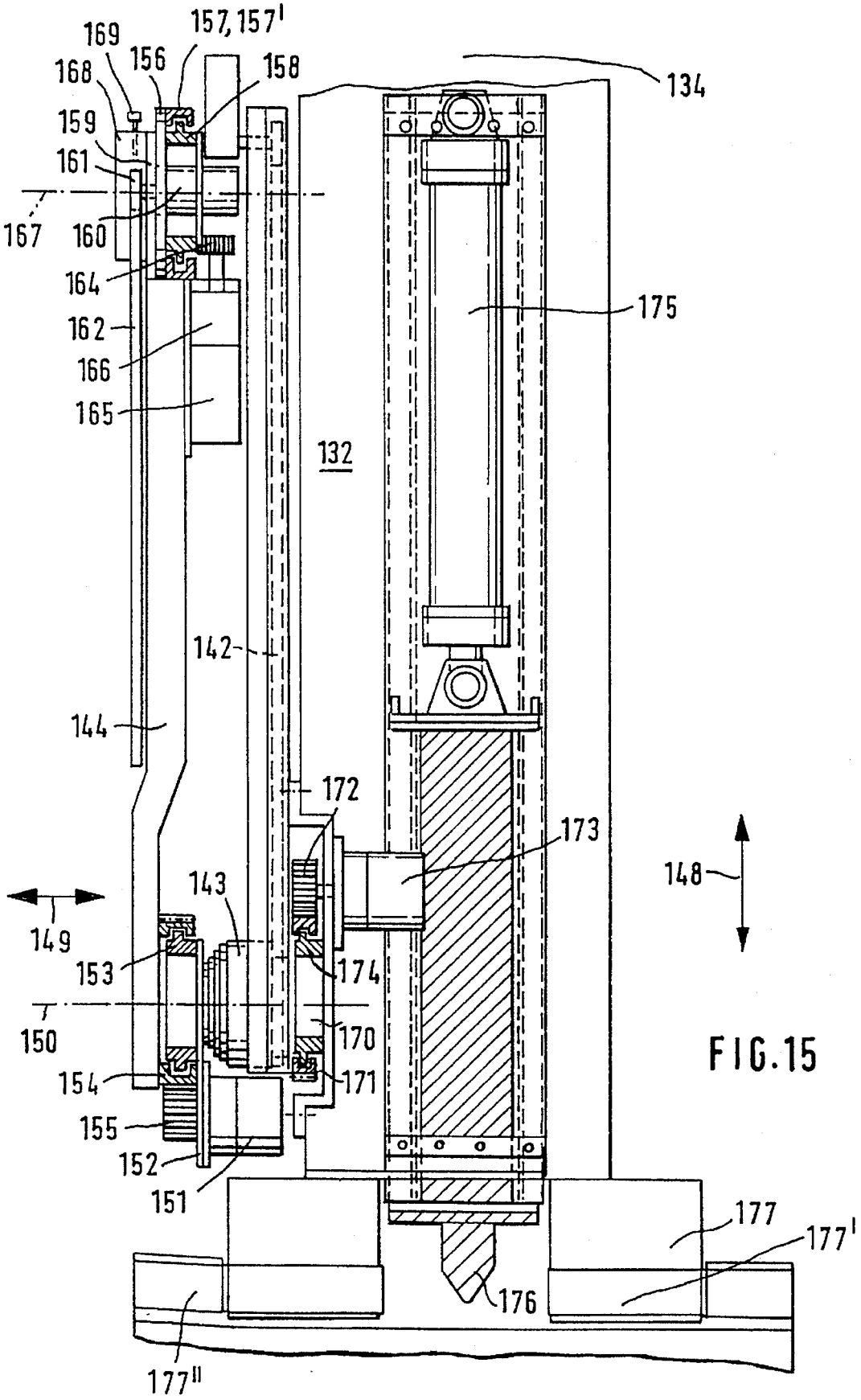
FIG. 15 is a side view of a modified embodiment form of a handle similar to FIG. 14.

FIGS. 13 to 15 show special constructions of the lower handle part of an excavator, particularly its outfitting with supplemental elements.

In particular, the lower part of a handle is designated by 132 in FIG. 13; its digging tool 133 including associated hydraulic actuation is only suggested in the drawing. Instead of a digging tool 133, any other conventional tool, e.g. a gripper member, can also be provided. A pivot connection can also be connected at 134.

A supplemental arm which is articulated at the part 132 via a hinge point 136 is designated by 135. A piston/cylinder unit 37 is provided for the swiveling of the supplemental arm 135. The supplemental arm 135 carries a running roller 138 at its end remote of the hinge point 136 and to this extent the supplemental arm 135 is comparable in terms of operation with the supplemental arm 76' carrying the running roller 76 according to FIG. 9.

A carriage which is received so as to slide in a dovetail guide 140 extending in the longitudinal direction of the handle 132 is designated by 139. A motor 141 in a working connection with a chain drive 142 serves for the drive of the carriage 139 along the dovetail guide 140. The chain drive 142 is constructed as a revolving chain which is connected with the carriage 139. A spindle drive can also be provided in place of a chain drive.

The carriage 139 carries a telescoping arm 143 which can telescope, preferably hydraulically, vertically with respect to the drawing plane of FIG. 13. The telescope arm 143 can also be articulated so as to swivel at the carriage 139, the swivel angle being adjustable by a piston/cylinder unit.

A boom arm 144 carrying a chain saw 145 at its end remote of the telescope arm 143 adjoins the telescope arm 143. A motor serving to drive the chain saw and a gear unit associated with this motor are shown schematically and designated by 146, 147, respectively. The chain saw 145 including the motor gear unit 146, 147 can also be connected to the boom arm 144 with the use of a pivot connection whose axis extends vertically with respect to the drawing plane of FIG. 13. Finally, the boom arm 144 can also be constructed so as to telescope in turn so that the distance between the motor 146 and the arm 143 is variable.

FIG. 14 shows a side view of an embodiment form of a boom arm 144 including the tool and articulation at the lower part 132 of a handle corresponding to FIG. 13. The telescope arm 143 is movable in turn in the direction of the arrow 148 via a carriage, not shown in the drawing, with the assistance of the chain drive 142. The articulation point of the boom arm 144 at the telescope arm 143 is movable in the direction of the arrow 149 by the telescoping of the latter 143. Moreover, the boom arm 144 is rotatable around the axis 150 by at least 360°. A motor 151 is used for this purpose, preferably a hydromotor which is structurally combined with a brake device, e.g. a multiple-disk brake, and is arranged in turn at a fastening plate 152. The fastening plate 152 in turn forms the end element of the telescope arm 143 and is securely connected with the latter. It simultaneously carries the inner ring 153 of a roller bearing 154 whose outer ring is securely connected with the boom arm 144 and is provided with external teeth which mesh with a pinion 154 arranged on the driven shaft of the motor 151.

A fastening plate which is located at the end of the boom arm 144 remote of the axis 150 and securely connected with it is designated by 156. The outer ring 157 of a roller bearing 157' whose inner ring is designated by 158 is fastened at the fastening plate 156 on its side facing the part 132. The inner ring 158 is securely connected with another fastening plate 159. A motor 160 extending inside the inner ring 158 is arranged on the fastening plate 159. The chain saw 162 is driven via a pinion 161 located on its driven shaft. In principle, the motor 160 can be constructed as desired and in particular structurally combined with a brake device, e.g. a multiple-disk brake.

A toothed rim which is arranged on the side of the inner ring 158 remote of the fastening plate 159 is designated by 163 and is in a working connection with the pinion 164 of a motor 165 which is fastened in turn at the boom arm 144. A brake and locking device is designated by 166. The design of the motor 165 is optional in principle, but is preferably a hydromotor, e.g. an axial piston motor. It can be seen that the motor 165 enables a rotation of the chain saw 162 around the axis 167. The chain housing in the region of the pinion 61 is designated by 168 and a spray nozzle for oil or other lubricant is designated by 169. Another spray device can be provided instead of the nozzle 169, e.g. a spray device for coolant, water, etc. The latter is required, for example, in diamond saw blades which can be provided in place of the chain saw 162. The spray device is connected with a supply arrangement which is not shown in the drawing.

It can be seen that numerous additional work processes can be achieved with additional outfitting of the handle part corresponding to FIGS. 13 and 14, e.g. in forestry where a tree can be grasped by a gripping member and cut down by the saw, specifically with the strictest adherence to safety considerations and the avoidance of damage to other trees as a result of the felling process. The device according to the invention can accordingly also be used in agriculture and forestry and e.g. constructed as a wood moving machine or contact harvester.

In principle, a great number of different tool and handling devices can be arranged at the boom in the region of the handle wherever exact control of adjusting or advancing movements proceeding from a fixed point is desired.

The embodiment example shown in FIG. 15 corresponds to a great extent to that in FIG. 14. However, the connection between the telescope arm 143 and the part 132 is now characterized by another pivot connection 170 in addition. The outer ring of a roller bearing which is securely connected with the telescope arm 143 and whose external teeth engage with the pinion 172 of a motor 173 is designated by 171. The inner ring 174 of this roller bearing is securely connected with the carriage which is movable in the direction of the arrow 148 via the chain drive 172. The motor 173 is likewise fastened to this carriage. It can be seen that the boom arm 144 is rotatable in an optional manner around the axis 150 via the motor 173. The motor 173 can be provided with a brake and locking device, not shown in the drawing, so that the boom arm 144 can be stopped in optional angular positions.

Another construction is directed to the part 132 and the digging tool. Thus, a piston/cylinder unit whose piston acts on a drill or hammer tool 176 which is displaceable in a straight line inside the part 132 in the direction of the arrow 148 is designated by 175. In this case, the digging tool is a shovel 177 whose axis is constructed in two parts. The aforementioned tool can project out and act in the intermediate space between parts 177, 177".

Figure 16:
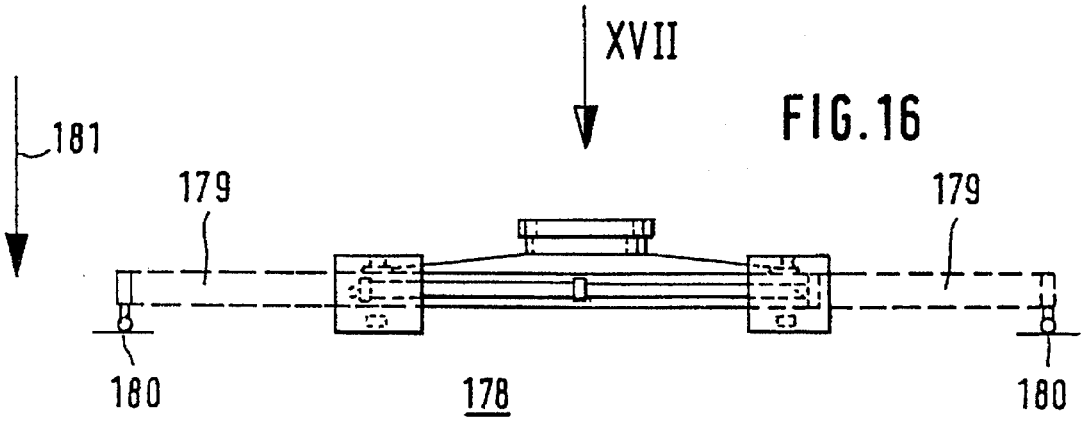
FIG. 16 shows a front view of a running gear of an excavator.
Figure 17:
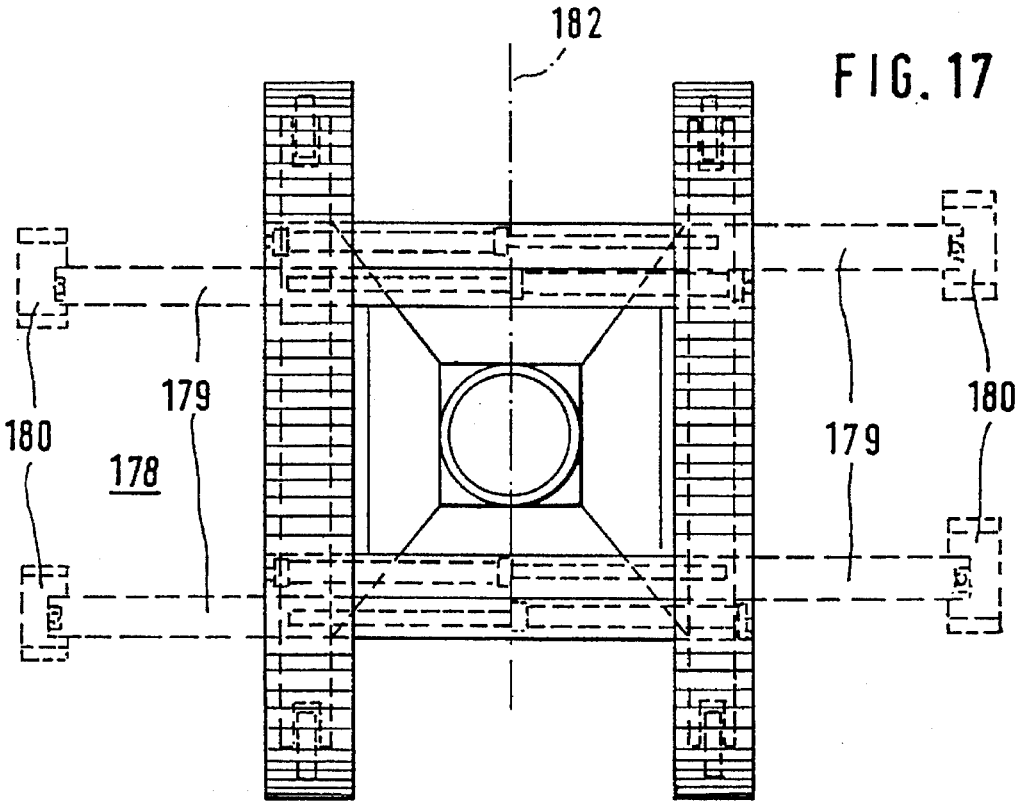
FIG. 17 shows a top view of a running gear according to arrow XVII of FIG. 16.

Finally, FIGS. 16 and 17 show a construction of the running gear of an excavator or crane which is important particularly in connection with telescoping booms and is suitable for improving the protection against tilting in unfavorable positions.

In particular, FIGS. 16 and 17 show a chain running gear 178 which is provided with supports 179 which can move out laterally, particularly in a horizontal plane, and are arranged in pairs at a distance from one another and are movable between a retracted position, i.e. in which they are completely drawn into the contour of the running gear 178, and a maximum moved out position. Piston/cylinder units are provided for the drive of these supports 179. The supports 179 carry support feet 180 at their outer end, i.e. the end remote of the chain running gear 178, which support feet 180 end in disk-like or plate-like standing parts, are displaceable vertically, i.e. in the direction of the arrow 181, when acted upon by pressure, and are possibly fastened in the region of their fastening points at the supports 179 so as to be swivelable around horizontal axes.

It can be seen that the protection against tilting with reference to the axis 182 is improved corresponding to the moved out state of the supports 179 when the support feet 180 stand on the ground.

The system of supports 179 and support feet 180 can also be arranged in the superstructure of the excavator or other vehicle in principle.

Figure 18:
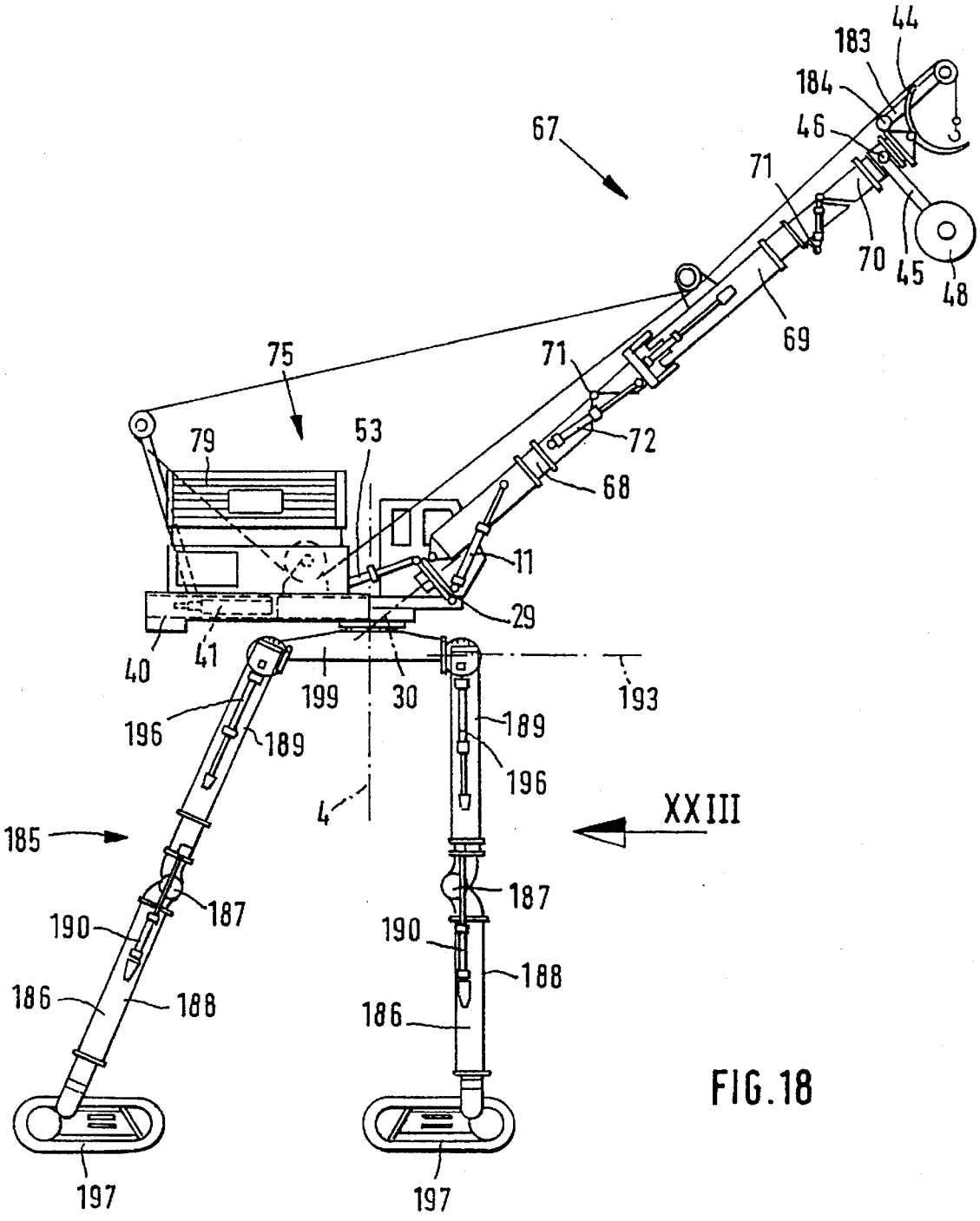
FIG. 18 shows a view of another embodiment form of the device according to the invention.

The embodiment example shown in FIG. 18 is characterized by a boom 67 which substantially corresponds to that of FIG. 9. A first supplemental arm 45 which guides a saw blade 48 and is swivelable at least around an axis 46 vertically with respect to the drawing plane of FIG. 18 and another supplemental arm 183 which is supported so as to be swivelable at least around an axis 184 and guides a hoist are arranged at the end of the handle 70. However, the vehicle 75 is characterized by a modified running gear 185 in contrast to the vehicle shown in FIG. 9 for example. In the following, FIG. 23 is referred to in a supplementary way for the description of the running gear.

The running gear 185 is characterized by four support booms 186, all of which include two parts 188, 189 which are connected with one another in an articulated manner via hinge points 187 whose axes extend vertically relative to the drawing plane of FIG. 18. The support booms 186 are articulated at the four corner points of the vehicle 75. Piston/cylinder units 190 are provided in each instance for the motor-driven swiveling around the hinge points 187. As can be seen particularly in FIG. 23, the piston/cylinder units 190 are located on both sides of the support boom 186 and the swiveling axis of these hinge points is designated by 191.

Figure 23:
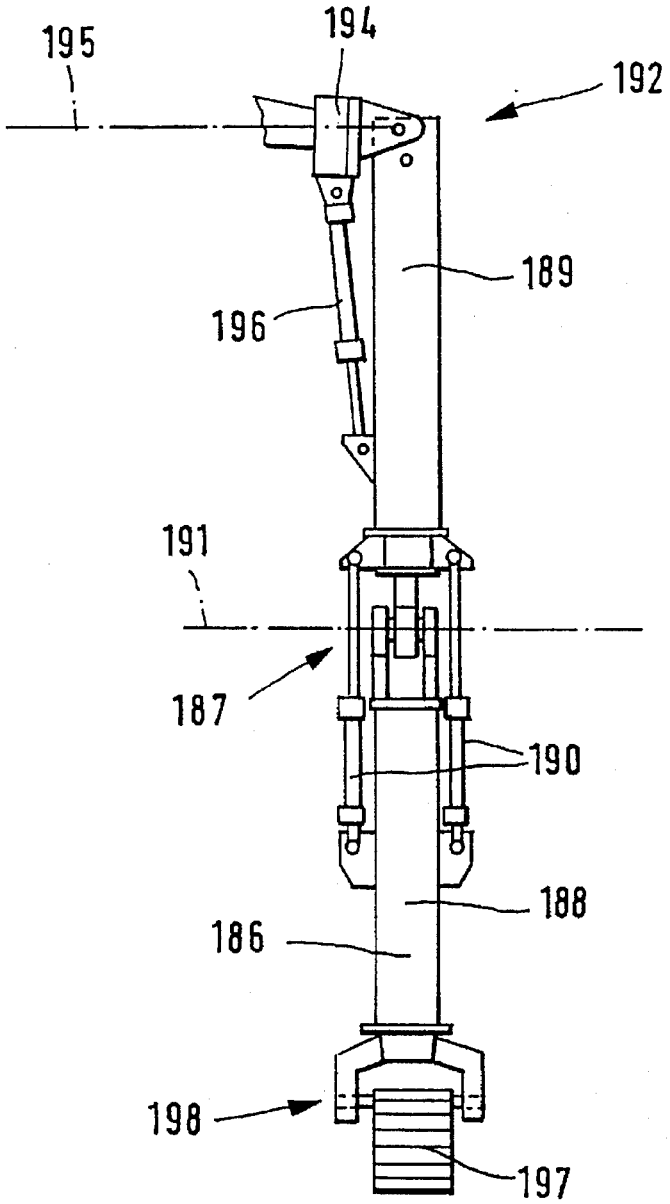
FIG. 23 shows a partial view of the device according to arrow XXIII of FIG. 18.

The support booms 186 are connected with the vehicle 75 via a hinge point 192 whose axis extends vertically relative to the drawing plane of FIG. 23. The axis of this hinge point 192 is designated by 193 in FIG. 18. The hinge point 192 is directly connected with the vehicle 75 via a pivot connection of the type described in the beginning. The axis of this pivot connection 194 is designated by 195 in FIG. 23.

It can be seen that swiveling movements of the support booms 186 within the drawing plane of FIG. 18 are enabled by pivot connections 194 which are constructed with a motor drive. Additional swiveling movements are possible vertically relative to the drawing plane of FIG. 18 by making use of the hinge points 192. Piston/cylinder units which serve to drive the swiveling movements around the axes 193 are designated by 196.

Each support boom 186 carries an individual tracklaying gear 197 at its end remote of the vehicle 75, which tracklaying gear 197 can also be constructed in principle as a conventional pneumatic tire running gear. The connection of the tracklaying gear 197 or other running gear arranged here with the lower end of the respective support boom is effected via a cardan joint 198, indicated in the drawing, which accordingly enables swiveling movements of the tracklaying gear 197 around two axes which are vertical relative to one another. A comparable articulation enabling swivelable movements can also be considered in place of a cardan joint 198.

It is substantial that every tracklaying gear 197 and the lower part of the undercarriage 199 be provided with coupling devices which are intended and constructed for producing a direct connection between the individual running gears 197 and the undercarriage 199 and which are arranged in particular in such a way that a coupling of the tracklaying gear 197 at the undercarriage 199 is possible simply by swiveling the parts 188, 189 of the individual support booms. The exact construction of the fastening of the support booms at the tracklaying gear 197 and at the hinge points 192 is advisably dimensioned in such a way that these connections are detachable without considerable manipulation and particularly with the use of a relatively simple tool. A connection between the tracklaying gear 197 and the undercarriage 199 can be carried out in the same way. As a result, the device shown in FIG. 18 can be used in quite a large number of ways, e.g. in the construction of tall buildings, but also in bridge building, e.g. with construction in rivers or other bodies of water. At the same time, the shown device can also be used as a conventional excavator or the like of the type already described in the beginning by swiveling the support booms in the manner described above and connecting the tracklaying gear 197 with the running gear 199.

A conventional gripping tool arranged at the end of the handle 70 is designated by 44. In the device shown in FIG. 18 all tracklaying gear is naturally drivable individually. Coupling devices which can be used between the tracklaying gears and the undercarriage 199 can be formed e.g. by pairing a T-guide and sliding block.

Figure 19:
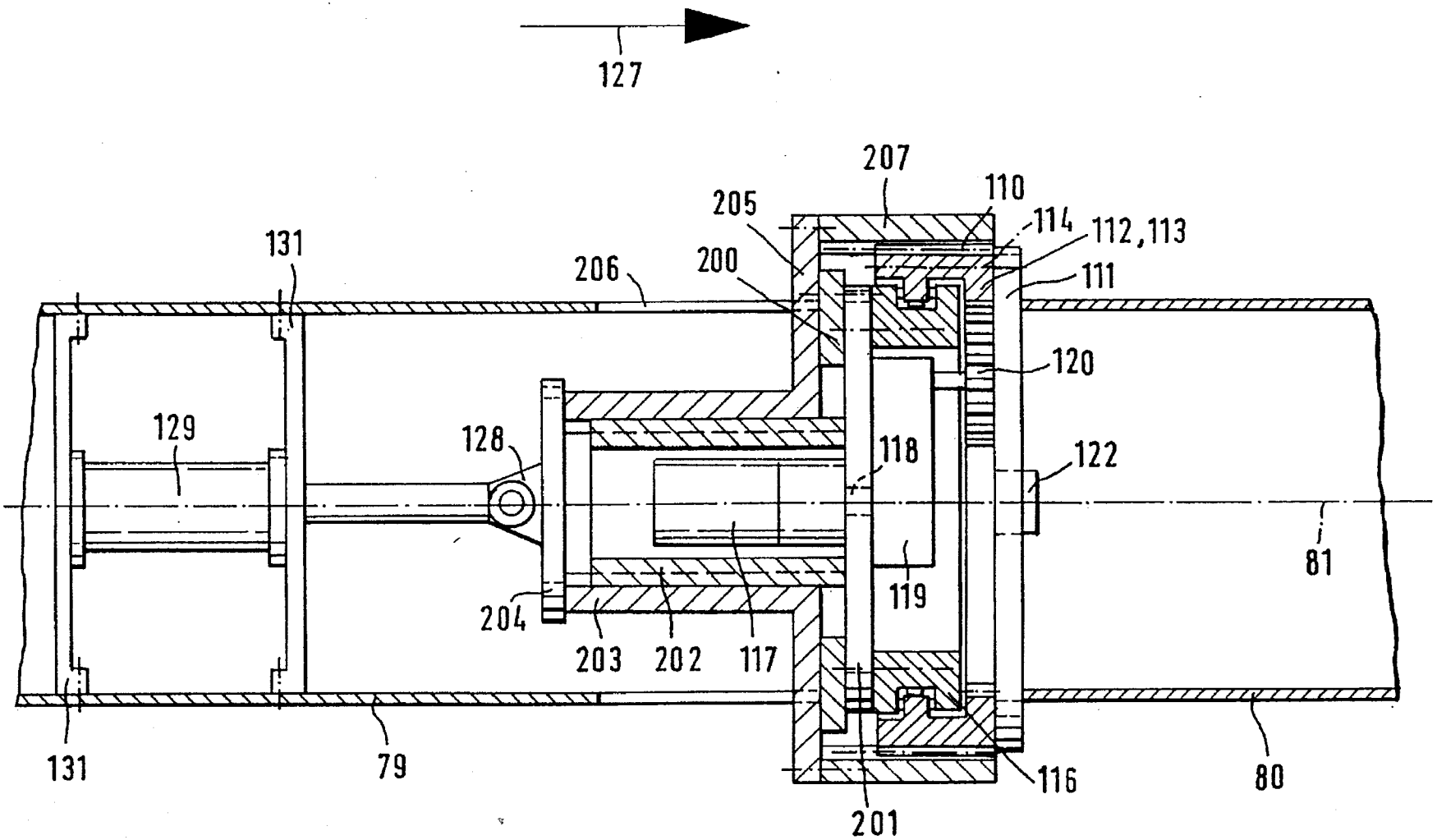
FIG. 19 shows a sectional view of another embodiment form of a rotary transmission to be used according to the invention.

FIG. 19 shows an alternative embodiment form of a pivot connection which substantially corresponds to that according to FIG. 12. However, it differs from the latter in the following respects:

A circular ring plate fastened at the end of the part 79 on the front side is designated by 200. An annular plate 201 which extends coaxially to the axis 81 in the same way as the circular ring plate 200 is arranged at the end of the latter remote of the aforementioned front side, the inner ring 116 of the roller bearing 113 being arranged at the annular plate 201. The annular plate 201 corresponds to the circle plate 115 according to FIG. 12 with respect to function and serves to fasten the motor 117 which is in a working connection with the pinion 120 via the gear unit 119. The motor 117 is located inside a guide pipe 202 which is located on the side of the annular plate 201 remote of the gear unit 119 and is fastened at the latter. The guide pipe 202 serves for the guidance of a guide cylinder 203 coaxially relative to the axis 81, the end of the guide cylinder 203 remote of the annular plate 201 being terminated by a plate 204 at which the coupling device 128 which produces the connection with the piston/cylinder unit 129 is arranged. The guide cylinder 203 is accordingly displaceable in a straight line in the direction of the arrow 127 and in the opposite direction when the piston/cylinder unit 129 is acted upon.

Suitable tongue-groove elements which are suggested in the drawing are provided for guiding the guide cylinder 203 on the guide pipe 202 so as to be fixed against rotation.

A system of radially extending cross-pieces 205 which are uniformly distributed along the circumference and penetrate a corresponding number of slots 206 of the part 79 which extend parallel to the axis is located at the guide cylinder 3 on its end remote of the plate 204. A cylindrical part 207 which corresponds to the cylindrical part 208 according to FIG. 12 with respect to function and carries teeth 110 radially at the inside is arranged at the radially outer end of the cross-piece 205. The fastening of the cylindrical part 207 at the cross-pieces 205 can be effected in an optional manner in principle.

It can be seen from the preceding statements that when the piston/cylinder unit 129 is acted upon by pressure in this way resulting in a movement of the plate 204 and accordingly of the guide cylinder 203 in the opposite direction to that of the arrow 127, the meshing of the teeth of the cylindrical part 207 with the outside of the outer ring 112 is disengaged so as to enable a rotation of the parts 79, 80 in this disengaged state via the motor 117 and with the cooperation of the angle measuring device 122. When the new angular position is reached an engagement of the teeth 110 is again effected when the piston/cylinder unit 129 is acted upon by pressure in a corresponding manner in the direction of the arrow 127 and the angular position is fixed in this way. Accordingly, in contrast to the embodiment example according to FIG. 12, only the guide cylinder 203 including the cylindrical part 207, and not a complete part 80 or 79, is moved during the disengagement of the teeth, so that a substantially smaller expenditure of energy is sufficient for disengaging the teeth.

Naturally, the slots 206 are dimensioned so as to enable the movability required for disengaging the teeth.

In the shown embodiment example the piston/cylinder unit 129 can be acted upon at both sides. However, a piston/cylinder unit which can be acted upon at one side can also be used in the same way. In this case, a restoring spring similar to the system according to FIG. 12 must be used.

Figure 20:
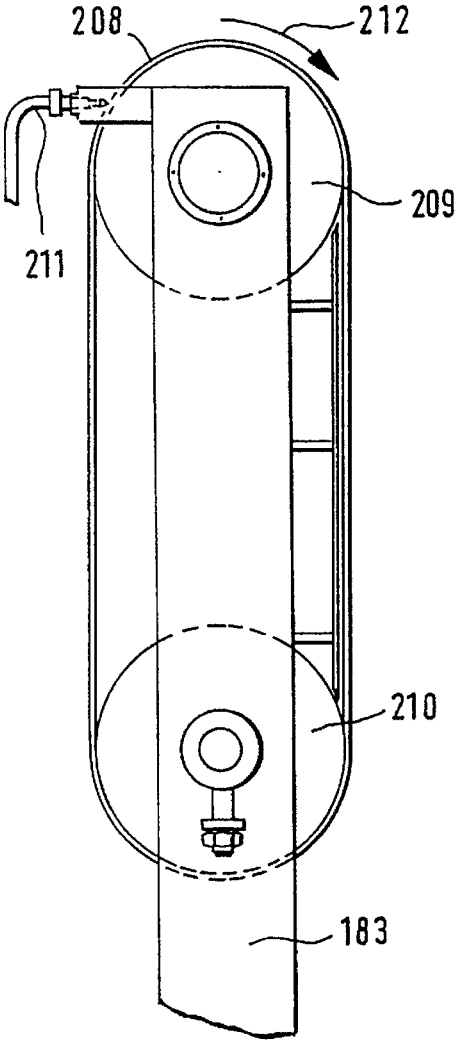
FIG. 20 shows a view of a tool arranged at a supplemental arm.

FIG. 20 shows a tool arranged at the end of a supplemental arm 283, which tool can be manipulated via the device according to the invention. This is a tool for applying mortar and plastering building walls.

A rotating belt, designated by 208, is guided along two rollers 209, 210, serves as a transporting means for the mortar and must be guided via the arm 283 as parallel as possible to the wall to be plastered. The belt comprises a suitable work material which does not lead to a caking of the mortar and lateral guides, not shown in the drawing, which extend parallel to the borders of the belt 208 are provided in the area of application for the mortar layer.

A nozzle arrangement by which the mortar is applied to the belt so as to be distributed as uniformly as possible is designated by 211. The belt 208 rotates in the direction of the arrow 212 via a motor drive of one of the rollers 209, 210 and effects the application of mortar in connection with a corresponding guiding of the supplemental arm 183 which is effected parallel to the surface of the building wall to be plastered.

Figure 21:
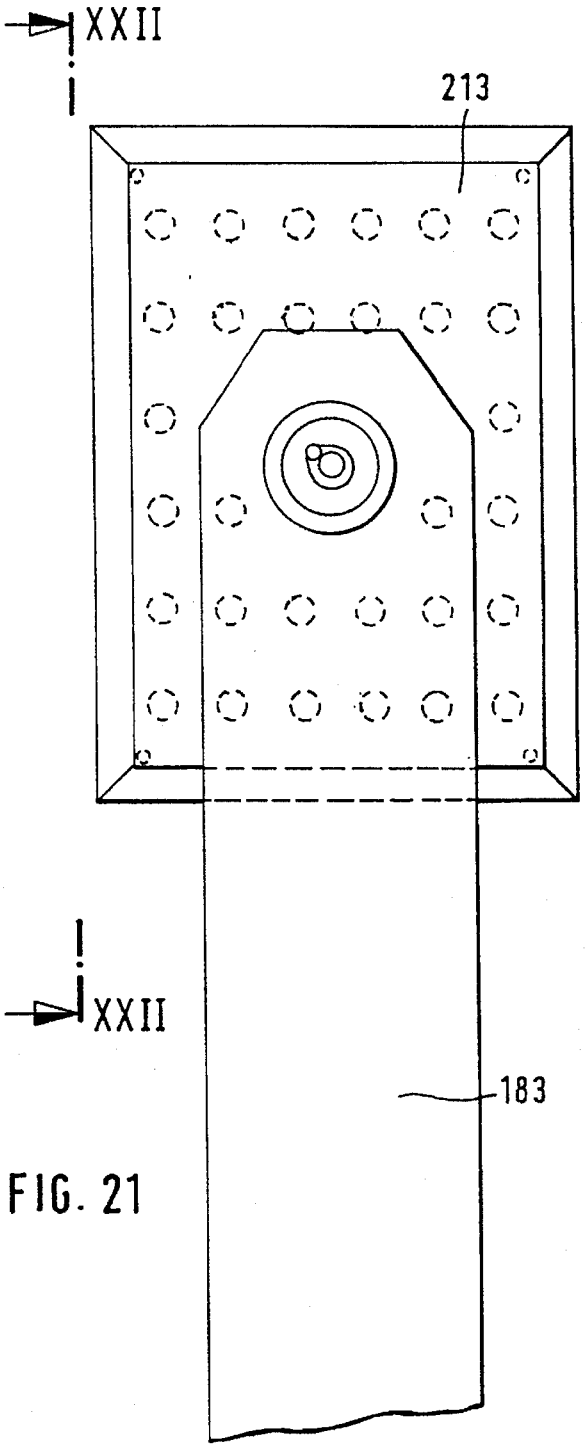
FIG. 21 is a top view of another tool fastened at a supplemental arm.
Figure 22:
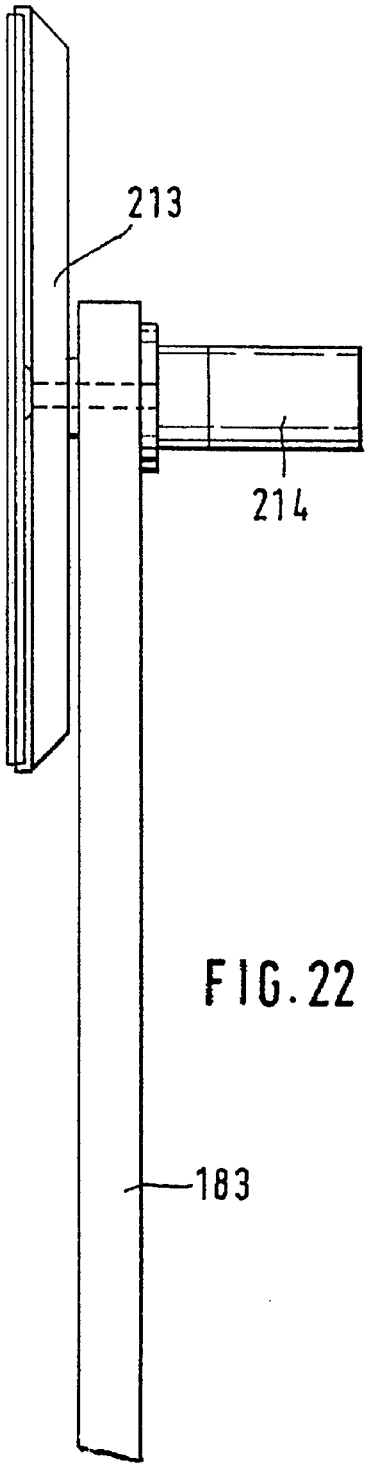
FIG. 22 shows a view of the tool corresponding to a plane XXII—XXII of FIG. 21.

FIGS. 21 and 22 show an alternative embodiment example of a tooling of the supplemental arm 183. This involves a vibrating grinder 213 whose drive system is designated by 214.

Figure 24:
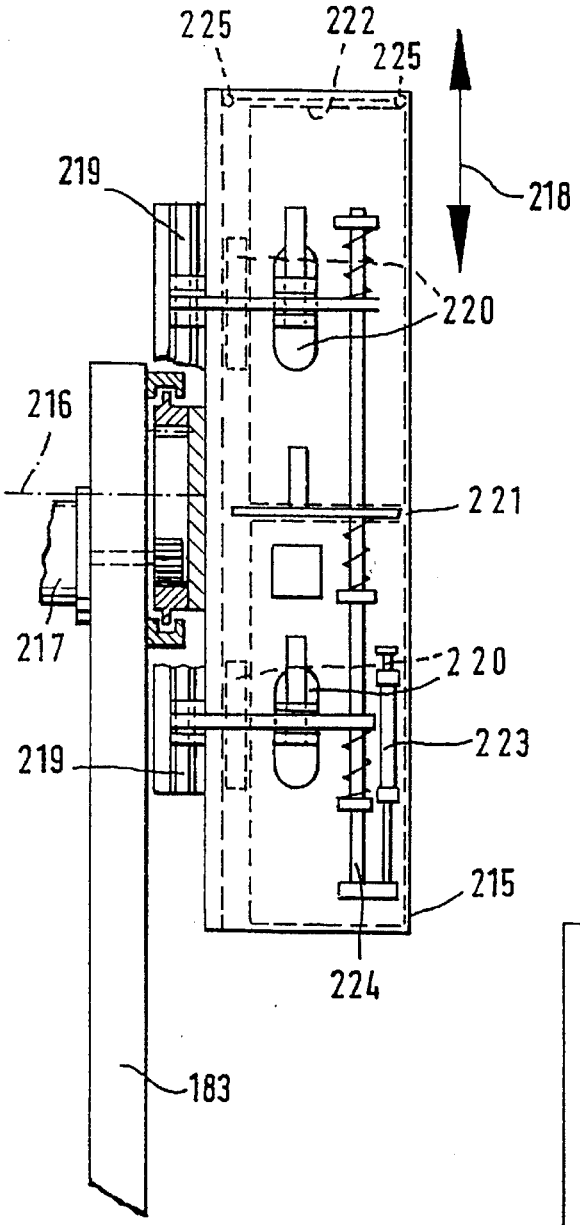
FIG. 24 shows a top view of another tool fastened at a supplemental arm.

The tool shown in FIG. 24 and arranged at the supplemental arm 183 is a lifting and handling device which is designed especially for the handling e.g. of square-stone formations such as building blocks for tall buildings. To this end, a frame 215 is supported so as to be rotatable around the axis 216 by a drive 217. The frame 215 is supported so as to be displaceable, likewise by a motor, in a straight line in the direction of the arrow 218 relative to an intermediate carrier 219 which forms the direct connecting element to the aforementioned rotatable support. The rotatable support can be effected in the manner of the pivot connection which has already been shown in the preceding so that an exact description can be dispensed with.

Suction cups 220 which act above and to the side of the building block to be manipulated serve to grasp the aforementioned building blocks directly. Of course, the suction cups 220 are connected with a vacuum source which is not shown in the drawing.

Spacers by which the blocks are held at a defined distance from one another are arranged in the intermediate space 221 of the two building blocks 222 shown in dashed lines. A suitable connecting means, e.g. mortar or a suitable cementing material, can be introduced into this intermediate space 221.

A linear movement can be exerted on the held building block 222 in the direction of the arrow 218 by a piston/cylinder unit 223 which is fastened at the frame in a suitable manner and is in a working connection with a sliding device 224 so as to enable the placement of these building blocks 222 on blocks already in place accompanied by a defined contact pressure. Sensors which operate in a contactless manner and detect the distance to defined reference edges can be arranged at auxiliary devices as well as for receiving the blocks 222 as indicated at 225. For example, these systems can be ultrasonic, laser or other systems. These sensors communicate with an overriding control unit and accordingly likewise contribute to the exact positioning of the building blocks 222.

Figure 25:
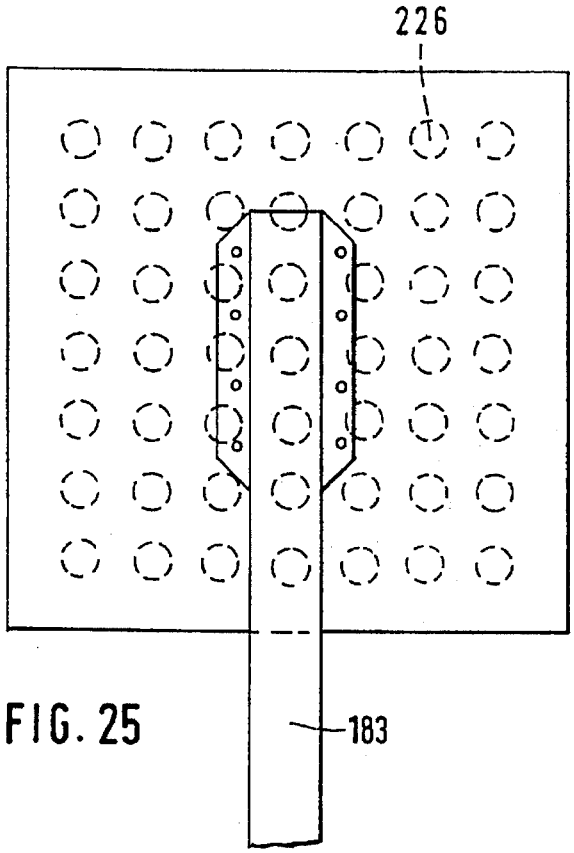
FIG. 25 shows a top view of a tool fastened at a supplemental arm which is similar to the subject matter of FIG. 24.

The tool shown in FIG. 24 can be modified in a desired manner as shown in FIG. 25 in which a lifting device which likewise cooperates with a vacuum source is constructed in such a way that detection of plate-like objects is possible over a large surface area. Consequently, the hoist of FIG. 25 is provided with a square arrangement of suction cups 226 and moreover is outfitted with auxiliary devices, not shown in the drawing, for exactly grasping and positioning the building blocks to be manipulated.

Another modification of the system shown in FIG. 24 can consist in a construction for grasping more than two building blocks.

It will be understood that each of the elements described above, or two or more together, may also find a useful application in other types of constructions differing from the types described above.

While the invention has been illustrated and described as embodied in a device for controlling at least one attachment, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A device for guiding at least one tool or auxiliary device, comprising a base part; at least one boom articulated with said base part in an articulation and having at least two members connected with one another by a connection and also having an end supporting the tool, the connection of said members with one another and the articulation of said boom with said base part having hinge points formed for swivelling movements in at least one plane, each of said at least two members being subdivided into two elements which are fastened to one another by pivot connections situated between said hinge points so that at least two said pivot connections are provided in the device, said pivot connections being formed so that said elements are swivellable relative to one another over more than 360°, said pivot connections having axes extending in a longitudinal direction of said elements.

2. A device as defined in claim 1, wherein said articulation of said boom with said base part includes a pivot connection.

3. A device as defined in claim 2, wherein said pivot connection of said articulation has an axis with an angle of inclination adjustable with respect to a reference plane.

4. A device as defined in claim 2, wherein said pivot connection of said articulation is arranged in said articulated connection of said boom with said base part; and further comprising two piston and cylinder units which operate independently and are articulated at one end at a point of said boom and other end at said pivot connection so as to provide swivelling movement of said boom around said pivot connection.

5. A device as defined in claim 1; and further comprising additional swivel articulations connecting said elements with one another and connecting said boom at said base part, said additional articulations having axes extending parallel to adjacent cross-sectional planes of a respective one of said elements.

6. A device as defined in claim 5; and further comprising an independently controllable drive associated with each of said pivot connections and each of said additional swivel articulations.

7. A device as defined in claim 5, wherein said pivot connections and said additional swivel articulations are structurally combined.

8. A device as defined in claim 5, wherein said swivel articulations have a plurality of axes and are formed as structural units.

9. A device as defined in claim 1; and further comprising at least one supplemental arm which is articulated so as to be swivellable at the end of said boom carrying the tool, said supplemental arm guiding additional tools and/or carrying devices for attaching tools.

10. A device as defined in claim 9, wherein said supplemental arm has at least two members with member elements connected by hinge points for rotating movement around at least one axis; and an independently controllable drive associated with each of said hinge points.

11. A device as defined in claim 10, wherein the hinge points are formed so as to provide relative movements around axes perpendicularly relative to a longitudinal extension of said member elements.

12. A device as defined in claim 10, wherein said hinge points are formed so as to provide rotating movements around axes parallel to cross-sectional planes of said member elements are.

13. A device as defined in claim 10, wherein said boom provided with said supplemental arm has lines for providing energy and controlling the tool.

14. A device as defined in claim 10, wherein said boom with said supplemental arm is provided with a cable pull system for providing a tractive force in the region of the tool; and further comprising a motor-actuated cable winch arranged on said base part and being in a working connection with said cable pull system.

15. A device as defined in claim 1, wherein at least one of said members is formed as a telescopable member.

16. A device as defined in claim 1, wherein at least one of said elements is formed as a telescopable element.

17. A device as defined in claim 1, wherein said base part is at least a part of a land vehicle.

18. A device as defined in claim 1, wherein said base part is at least a part of a water vehicle.

19. A device as defined in claim 1, wherein said base part is a device formed for stationary erection.

20. A device as defined in claim 1, wherein said base part and said boom are components of a system which is a mobile excavator.

21. A device as defined in claim 1, wherein said base part and said boom are components of a system which is a mobile crane.

22. A device as defined in claim 1, wherein said base part and said boom are components of a system which is a mobile manipulating device.

23. A device as defined in claim 1, wherein said base part and said boom are components of a system which is a mobile building scaffolding with a work platform.

24. A device as defined in claim 1, wherein said base part and said boom are components of a system which is a stationary excavator.

25. A device as defined in claim 1, wherein said base part and said boom are components of a system which is a stationary crane.

26. A device as defined in claim 1, wherein said base part and said boom are components of a system which is a stationary manipulating device.

27. A device as defined in claim 1, wherein said base part and said boom are components of a system which is a stationary building scaffolding with a work platform.

28. A device as defined in claim 1, wherein said base part is provided with a balancing weight.

29. A device as defined in claim 28, wherein said balancing weight is displaceable to compensate for tilting moments.

30. A device as defined in claim 28, wherein said base part is provided with a supply arrangement for coolants, lubricants and other fluids.

31. A device as defined in claim 1, wherein said base part is provided with a tool store.

32. A device as defined in claim 1, wherein said boom is divided at least into one angled base boom and a handle provided with a tool.

33. A device as defined in claim 32, wherein the tool provided at said handle is a tool selected from the group consisting of a digging tool, a gripping tool, a tool for surface working of workpieces and other objects, a tool for cutting, a tool for non-cutting machining, a hoist and a mounting tool.

34. A device as defined in claim 32, wherein the tool provided at said supplemental arm is a tool selected from the group consisting of a digging tool a gripping tool, a tool for surface working of workpieces and other objects, a tool for cutting, a tool for non-cutting machining, a hoist and a mounting tool.

35. A device as defined in claim 1, wherein each said pivot connections includes a bearing for coaxially supporting said elements relative to one another, a drive and a brake and fixing device.

36. A device as defined in claim 35, wherein said bearing is a roller bearing.

37. A device as defined in claim 35, wherein said brake and fixing device includes at least a brake arrangement.

38. A device as defined in claim 35, wherein said brake and fixing device includes at least a retaining arrangement.

39. A device as defined in claim 35, wherein said brake and fixing device includes at least a brake arrangement which is arranged in series with said drive along a flow of force.

40. A device as defined in claim 35, wherein said brake and fixing device includes at least a retaining arrangement which is arranged in series with said drive along a flow of force.

41. A device as defined in claim 1, wherein said pivot connection has a drive; further comprising an angle measuring device for determining an angle of rotation between said elements; and a control unit coordinating a rotating movement of said drive and being in working connection with said angle measuring device.

42. A device as defined in claim 1, wherein said elements are in toothed engagement with one another; and further comprising an angle measuring device determining an angle of rotation between said elements; and a control unit coordinating an engagement and a disengagement between said elements and being in working connection with said angle measuring device.

43. A device as defined in claim 1, wherein said elements are telescopable; and further comprising a length measuring device associated with each of said telescopable elements.

44. A device as defined in claim 1; and further comprising supporting feet which are arranged on said base part and movable for standing on the ground, said feet being movable laterally.

45. A device for guiding at least one tool or auxiliary device, comprising a base part; at least one boom articulated with said base part in an articulation and having at least two members connected with one another by a connection and also having an end supporting the tool, the connection of said members with one another and the articulation of said boom with said base part having hinge points formed for swivelling movements in at least one plane, each of said at least two members being subdivided into two elements which are fastened to one another by pivot connections situated between said hinge points so that at least two of said pivot connections are provided in the device, said pivot connections being formed so that said elements are swivellable relative to one another over more than 360°, said pivot connections having axes extending in a longitudinal direction of said elements; and a supplemental arm composed of two elements connected with one another by a pivot connection.

46. A device for guiding at least one tool or auxiliary device, comprising a base part; at least one boom articulated with said base part in an articulation and having at least two members connected with one another by a connection and also having an end supporting the tool, the connection of said members with one another and the articulation of said boom with said base part having hinge points formed for swivelling movements in at least one plane, each of said at least two members being subdivided into two elements which are fastened to one another by pivot connections situated between said hinge points so that at least two of said pivot connections are provided in the device, said pivot connections being formed so that said elements are swivellable relative to one another over more than 360°, said pivot connections having axes extending in a longitudinal direction of said elements, said articulation having a pivot connection arranged at said articulated connection of said boom with said base part and constructed as a ball-and-socket joint; and two piston cylinder units operating independently and articulated at one end at a point of said boom and at the other end at points of said base part at a distance from one another so as to provide swivelling movement of said boom around its articulation point at the base part.

47. A device for guiding at least one tool or auxiliary device, comprising a base part; at least one boom articulated with said base part in an articulation and having at least two members connected with one another by a connection and also having an end supporting the tool, the connection of said members with one another and the articulation of said boom with said base part having hinge points formed for swivelling movements in at least one plane, each of said at least two members being subdivided into two elements which are fastened to one another by pivot connections situated between said hinge points so that at least two of said pivot connections are provided in the device, said pivot connections being formed so that said elements are swivellable relative to one another over more than 360°, said pivot connections having axes extending in a longitudinal direction of said elements, said articulation of said boom with said base part also including a pivot connection, each said pivot connections including a roller bearing for coaxially supporting said elements relative to one another, a drive and a brake and fixing device, said roller bearing having an outer ring, said drive including a motor and being in working connection with said outer ring of said roller bearing.

48. A device as defined in claim 47, wherein said drive also includes a gear unit.

49. A device for guiding at least one tool or auxiliary device, comprising a base part; at least one boom articulated with said base part in an articulation and having at least two members connected with one another by a connection and also having an end supporting the tool, the connection of said members with one another and the articulation of said boom with said base part having hinge points formed for swivelling movements in at least one plane, each of said at least two members being subdivided into two elements which are fastened to one another by pivot connections situated between said hinge points so that at least two of said pivot connections are provided in the device, said pivot connections being formed so that said elements are swivellable relative to one another over more than 360°, said pivot connections having axes extending in a longitudinal direction of said elements, said articulation of said boom with said base part also including a pivot connection, each said pivot connections including a roller bearing for coaxially supporting said elements relative to one another, a drive and a brake and fixing device, said elements being connected with one another by a tooth engagement which is disengageable.

50. A device as defined in claim 49, wherein said tooth engagement is disengageable by an axial displacement of said elements to exert a holding function.

* * * * *